United States Patent [19]

Taylor et al.

[11] 4,347,444

[45] Aug. 31, 1982

[54] AUTOMOTIVE BACKLIGHT HEATER AND TIMING CONTROL MEANS

[75] Inventors: Robert E. Taylor, Cadillac; Norman A. Rautiola, Reed City; Gerald K. Miller, Hersey, all of Mich.

[73] Assignee: Nartron Corporation, Reed City, Mich. ; a part interest

[21] Appl. No.: 119,214

[22] Filed: Feb. 7, 1980

[51] Int. Cl.[3] ..... H01H 43/00

[52] U.S. Cl. ..... 307/141

[58] Field of Search ..... 200/33 R, 315; 307/141, 307/141.4, 141.8; 361/160, 195; 219/203, 460, 492, 493, 502, 520, 522

[56] References Cited

U.S. PATENT DOCUMENTS

| | | | |
|---|---|---|---|
| 3,934,111 | 1/1976 | Roselli et al. | 219/203 |
| 3,944,893 | 3/1976 | Hayden | 219/203 X |
| 4,015,139 | 3/1977 | Cleary et al. | 200/33 R |
| 4,104,981 | 8/1978 | Ono et al. | 200/315 |
| 4,276,483 | 6/1981 | Hayden | 307/141 X |

*Primary Examiner*—James R. Scott

*Attorney, Agent, or Firm*—Lon H. Romanski

[57] ABSTRACT

An electrical switching and timing assembly is shown having a manually actuatable switch selectively closable and openable, an associated electrical circuit has an input end and an output end, the input end is intended for connection to a source of electrical potential while the output end is intended for connection to an electrical load, the associated circuit has a timing circuit effective for opening the associated circuit within a preselected span of time after the associated circuit has been closed by the manually actuatable switch, the manually actuatable switch being effective for opening the associated circuit even before the expiration of the preselected span of time.

93 Claims, 27 Drawing Figures

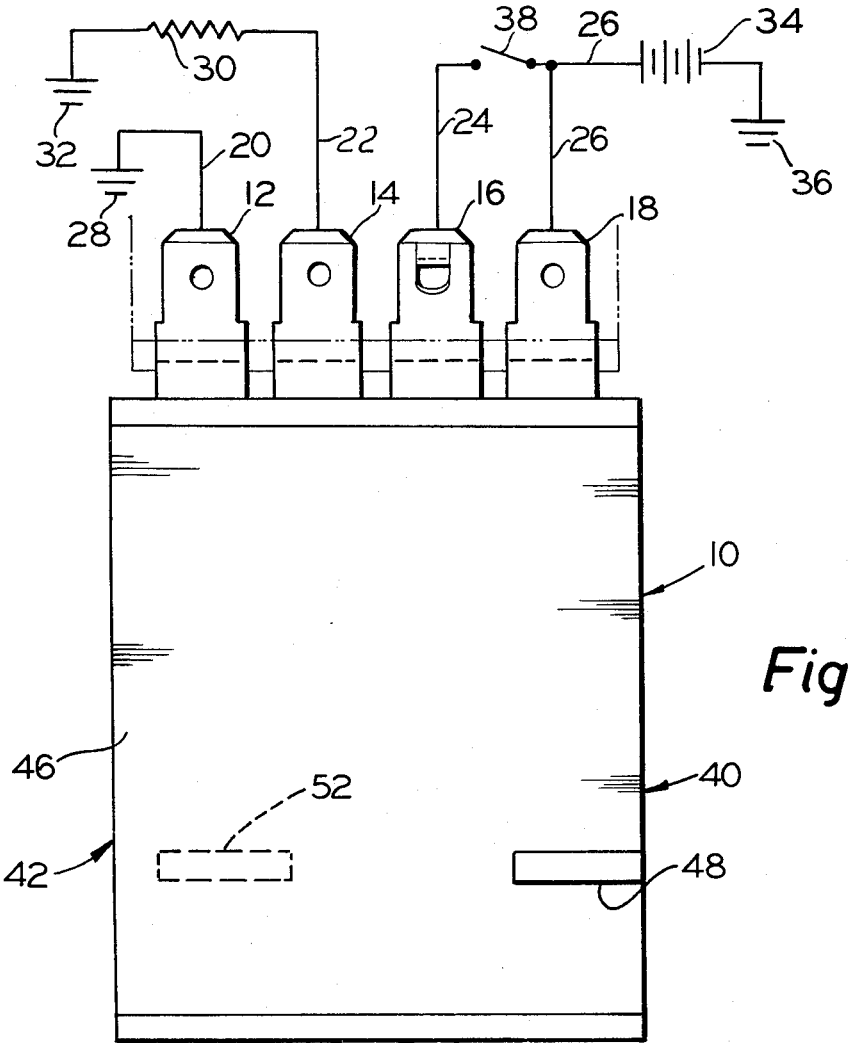
Fig. 1
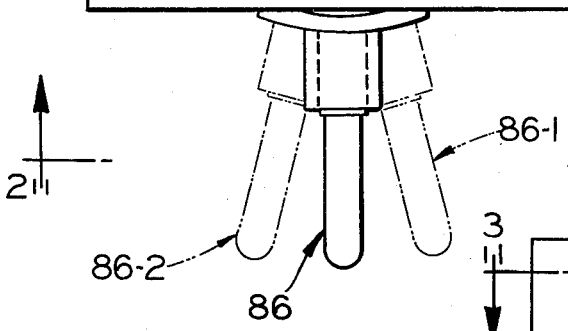
Fig. 2
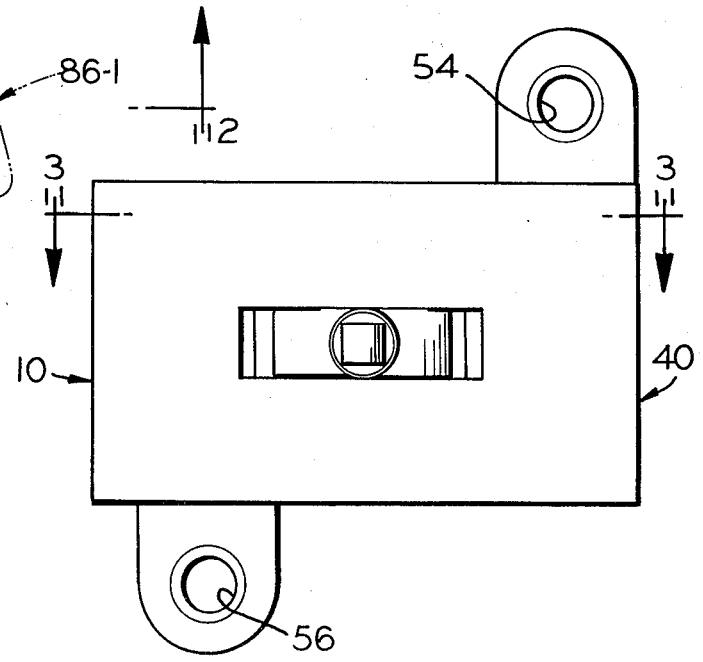

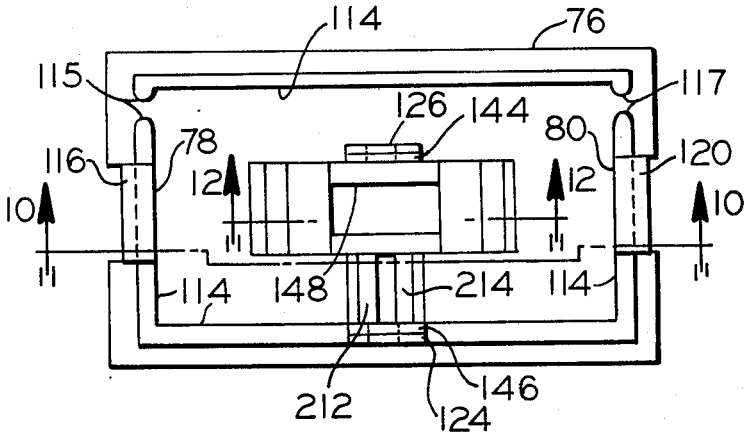
Fig. 9
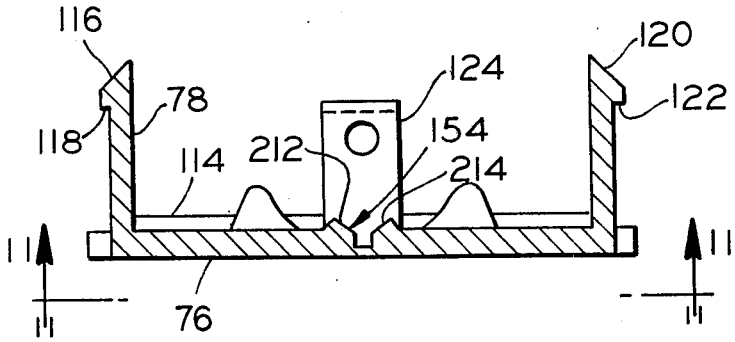
Fig. 10
Fig. 12
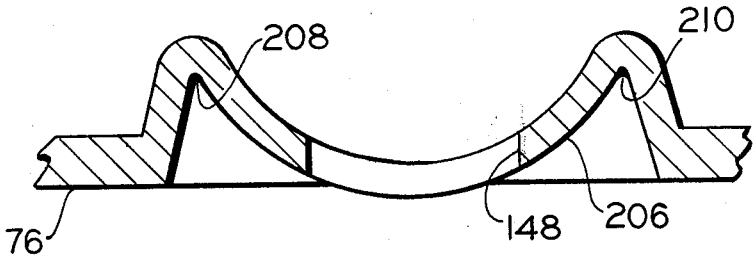
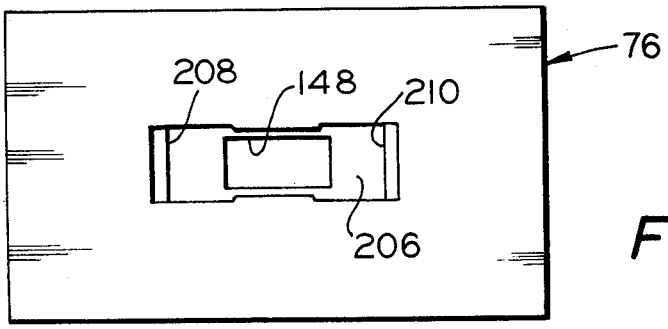
Fig. 11

AUTOMOTIVE BACKLIGHT HEATER AND TIMING CONTROL MEANS

FIELD OF INVENTION

This invention relates generally to the field of relatively high current switching and timing means and more particularly to such switching and timing means employable as for controlling automotive window heaters or the like whereby relatively high electrical current is supplied to the window heater for a limited period of time as, for example, in the order of ten minutes.

BACKGROUND OF THE INVENTION

Heretofore, the prior art has proposed the use of various electrical switching means and structures whereby, for example, the vehicle operator manually actuated such switching means to an electrically closed condition to thereby supply electrical current to the vehicular window heaters and, subsequently, upon some indeterminate span of time, the vehicle operator would manually actuate such closed switching means to an electrically open condition to thereby terminate electrical current to the window heaters. Such manual control often resulted in the operator forgetting to open the switching means thereby resulting in an attendant excessive current drain as on the vehicular battery.

In an attempt to overcome this problem, the prior art has proposed the employment of various timing circuits to be employed, in effect, in combination with the switching means in order to thereby limit the total time, as per any one occurrence of switch means closure, to a preselected maximum span of time. Such prior art devices have not been found acceptable for various reasons among which are that such prior art timing means usually exhibited variable time spans, instead of a substantially constant time span as desired and they are very sensitive to temperature and as a consequence thereof any one prior art timing means often exhibited variations in its timing function with such variations being temperature induced. Further, such prior art devices are usually quite complex requiring many electrical connections and other special considerations as in the installation thereof within an automotive vehicle.

Accordingly, the invention as herein disclosed, described and claimed is primarily directed to the solution of the foregoing and other related and attendant problems of the prior art.

SUMMARY OF THE INVENTION

According to the invention, an electrical switching and timing assembly comprises a unitary assembly in turn comprising manually actuatable switch means selectively manually closable and openable, circuit means having an input end and an output end, said input end being adapted for electrical connection to a source of electrical potential, said output end being adapted for electrical connection to associated electrical load means, said circuit means comprising electrical timing means effective for opening said circuit means within a preselected span of time after said circuit means has been closed by said manually actuatable switch means and wherein said manually actuatable switch means is effective for opening said circuit means even before the expiration of said preselected span of time.

Various general and specific objects, advantages and aspects of the invention will become even more apparent when reference is made to the following detailed description of the invention considered in conjunction with the accompanying drawings.

BRIEF DESCRIPTION OF THE DRAWINGS

In the drawings wherein for purposes of clarity certain details and/or elements may be omitted from one or more views:

FIG. 1 is what may be considered a top plan view of a switch control and timing circuit assembly embodying teachings of the invention shown, schematically, operatively connected to a source of electrical potential and a related electrical load the energization and de-energization of which is controlled by said assembly;

FIG. 2 is what may be considered as a front elevational view of the assembly of FIG. 1 taken generally on the plane of line 2—2 of FIG. 1 and looking in the direction of the arrows;

FIG. 9 is a view similar to that of FIG. 6 except that certain of the elements illustrated in FIG. 6 are not shown and the view is in relatively smaller scale;

FIG. 10 is a cross-sectional view taken generally on the plane of line 10—10 of FIG. 9 and looking in the direction of the arrows;

FIG. 11 is an elevational view taken generally on the plane of line 11—11 of FIG. 10 and looking in the direction of the arrows;

FIG. 12 is an enlarged fragmentary cross-sectional view taken generally on the plane of line 12—12 of FIG. 9 and looking in the direction of the arrows;

DETAILED DESCRIPTION OF THE PREFERRED EMBODIMENT

Figure 3:
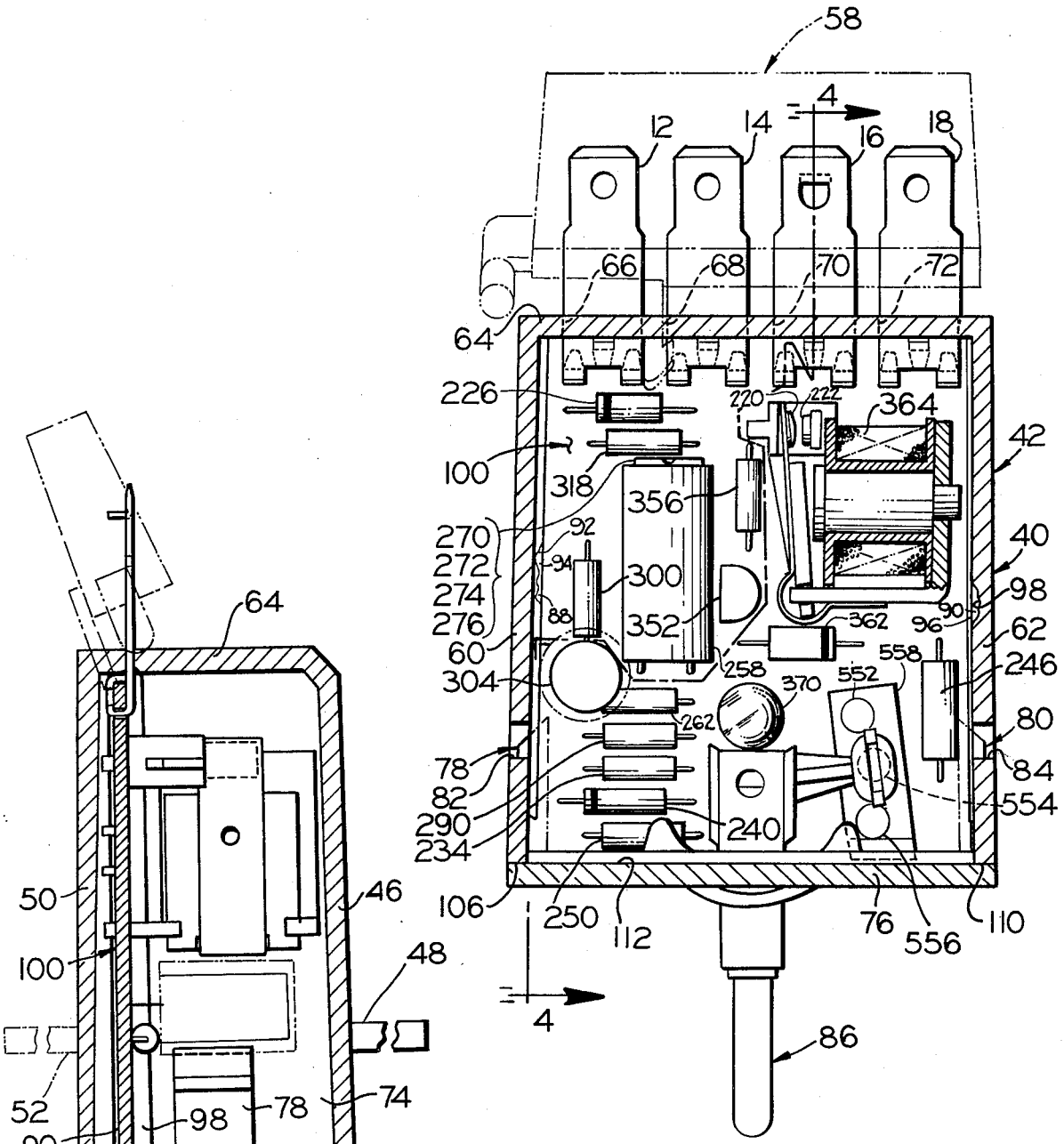
FIG. 3 is a relatively enlarged cross-sectional view taken generally on the plane of line 3—3 of FIG. 2 and looking in the direction of the arrows.

Referring now in greater detail to the drawings, FIG. 1 illustrates a heater and timing control assembly 10, as in top plan view, having terminals 12, 14, 16 and 18 which are connected as by conductor means 20, 22, 24 and 26 to various electrical components and circuit portions. That is, terminal 12 is electrically connected as via conductor means 20 to ground as at 28; terminal 14 is electrically connected as via conductor 22 to the related vehicular electrical window heater means 30 which, in turn, is electrically connected to ground as at 32; terminal 18 is electrically connected as via conductor means 26 as to the positive side of a source of electrical potential as, for example, battery means 34 which may be grounded as at 36. Terminal 16 is electrically connected to the source of electrical potential as via conductor means and vehicular operator actuated ignition switch means 38.

The assembly 10 is illustrated as comprising housing means 40 which, in turn comprises, preferably a plastic molded main body portion 42 having a forwardly (illustrated as downward in FIG. 1) disposed open end 44. Preferably the upper disposed wall 46 of housing body portion 42 is provided with an integrally formed mounting tab 48 while the lower disposed wall 50 of housing body portion 42 is preferably provided with an integrally formed mounting tab 52. As best seen in FIG. 2, mounting tabs 48 and 52 are respectively provided with apertures 54 and 56 as for the accommodation of mounting screws or the like therethrough.

Figure 4:
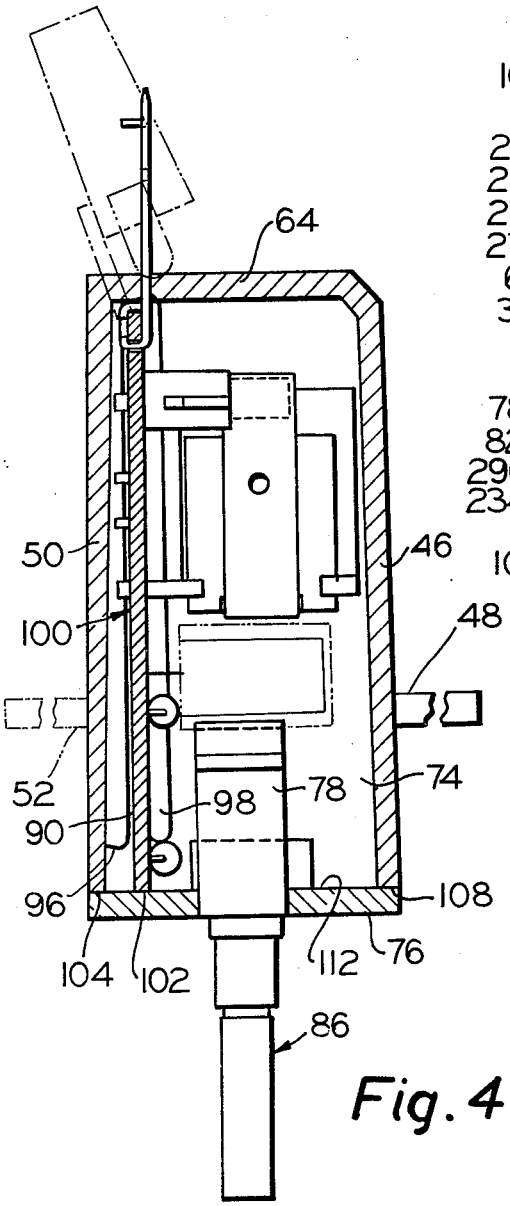
FIG. 4 is a cross-sectional view taken generally on the plane of line 4—4 of FIG. 3 and looking in the direction of the arrows.

FIGS. 3 and 4 illustrate, in cross-section, further details of the preferred embodiment of the assembly 10. Referring in greater detail to FIGS. 3 and 4, the terminals 12, 14, 16 and 18 are illustrated as being collectively connected as to a suitable terminal connector member 58 which, as well known in the art, carries suitable coacting terminals or contacts for electrical closure with terminals 12, 14, 16 and 18, respectively, in order to thereby achieve the circuitry depicted in FIG. 1. As can be seen, the housing main body portion 42 is preferably comprised of integrally formed top 46 and bottom 50 walls along with side walls 60 and 62 each of which are integrally joined as at their respective rearward ends with a rear wall 64 which, in turn, is provided with a plurality of clearance apertures or slots 66, 68, 70 and 72 for respectively accommodating the passage therethrough of terminals 12, 14, 16 and 18. Walls 46, 50, 60, 62 and 64 cooperate to define an internal chamber 74 which serves to contain the various related electrical components as well as at least a portion of the manually actuatable switching means each to be described in greater detail. The forward (illustrated as downward in FIGS. 3 and 4) open end of housing main body portion 42 is closed as by a transversely extending wall member 76 detachably securable to the main body portion 42 as by resiliently deflectable arms 78 and 80 which respectively cooperate with recess or abutment like portions 82 and 84. The forwardly situated wall 76 also serves to carry the manually actuatable switching member operatively connected to manually actuatable handle or lever means 86 to be described in greater detail.

As shown in FIGS. 3 and 4, internally formed guide and supporting slots 88 and 90 are respectively formed as by spaced longitudinally extending flange-like portions 92 and 94 along the inner surface of side wall 60 and spaced longitudinally extending flange-like portions 96 and 98 along the inner surface of side wall 62. A printed circuit board 100, carrying various electrical circuit portions and electrical components, having terminals 12, 14, 16 and 18 secured thereto, is slidably received as generally along its opposite side edges within guide slots 88 and 90 as to be thereby supported therewithin. When the printed circuit board 100 and components carried thereby are completely received within chamber 74, and supported by guides 92 and 90, the terminals 12, 14, 16 and 18 extend through their cooperating slots as to assume positions as generally depicted in FIGS. 3 and 4 while the forward edge or end 102 of printed circuit board 100 is brought into general planar alignment as with the forward edge or end surfaces 104, 106, 108 and 110 of walls 50, 60, 46 and 62. Accordingly, when front wall member 76 is brought into assembled relationship with the main housing body 42 the inner surface 112 of wall member 76 ideally abuts against the forward edges 104, 106, 108 and 110 of main housing body 42 and, at the same time, abuts against the forward end 102 of printed circuit board 100 to thereby lock and hold the printed circuit board 100 in assembled condition.

Figure 5:
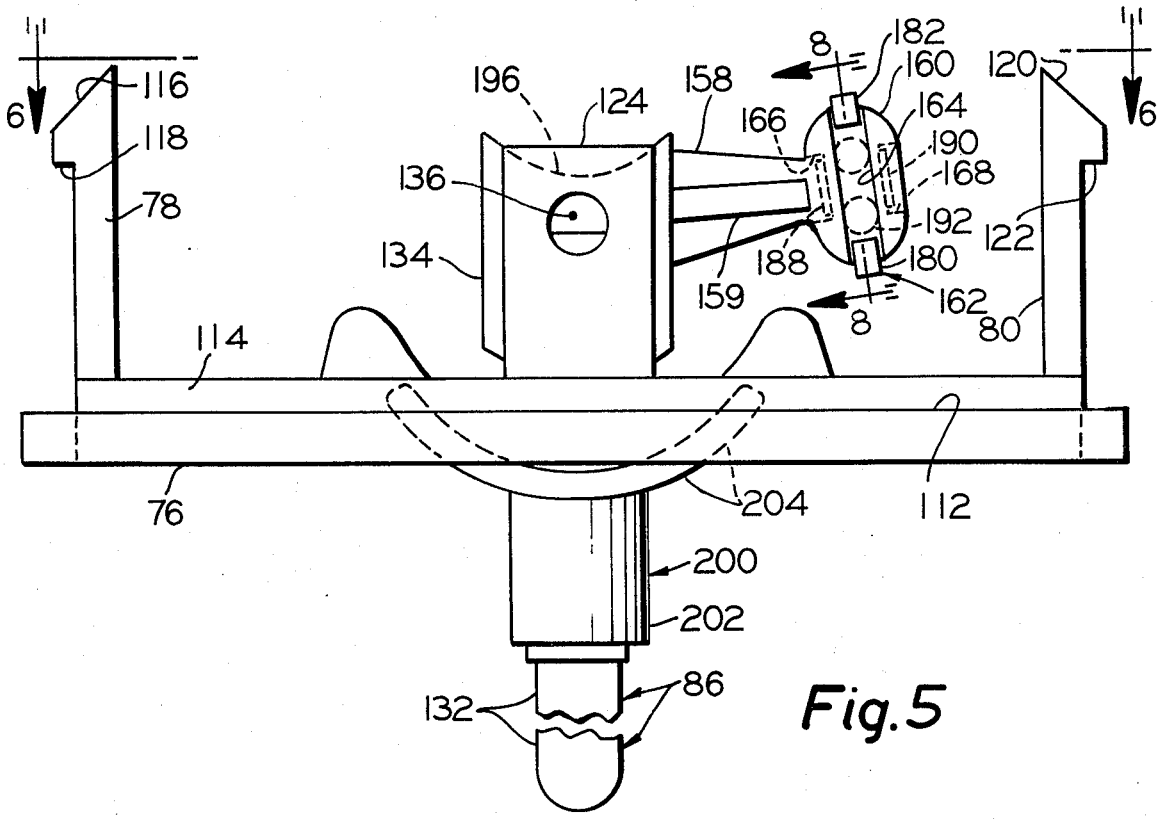
FIG. 5 is a top plan view, in relatively enlarged scale, of one of the sub-assemblies of the structure shown in FIG. 3.
Figure 6:
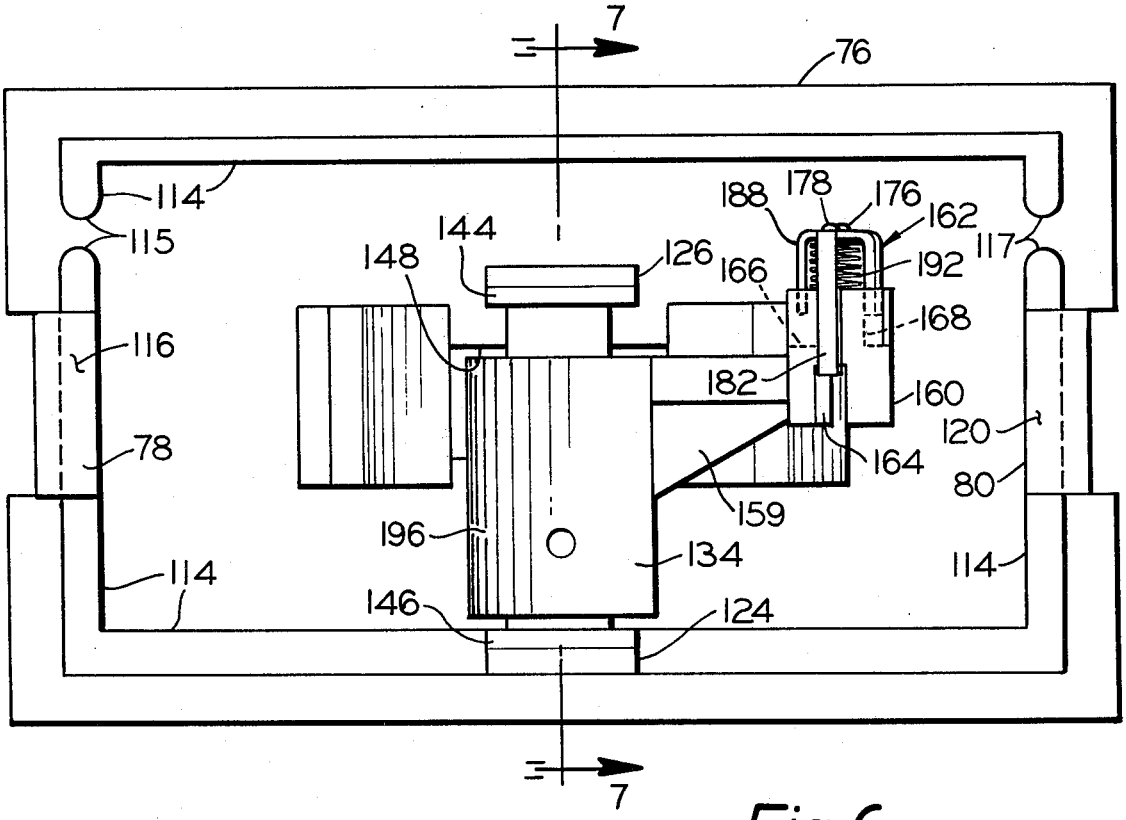
FIG. 6 is a view taken generally on the plane of line 6—6 of FIG. 5 and looking in the direction of the arrows.

FIG. 5 illustrates the forward wall member 76 and switch mechanism carried thereby in plan view, while FIG. 6 is a view taken generally on the plane of line 6—6 of FIG. 5 and looking in the direction of the arrows. Referring in greater detail to FIGS. 5 and 6 along with FIGS. 7 and 8 (FIG. 7 being a cross-sectional view taken in FIG. 6 and FIG. 8 being an enlarged cross-sectional view taken in FIG. 5) the forward wall member 76 and switching mechanism are illustrated as comprising an upstanding wall or flange-like portion 114, which may be discontinuous, integrally formed as with the inner surface 112 of wall 76, as to be situated generally inwardly from the outer periphery of the wall member 76. The flange-like portions 114 are closely received by the inner surfaces of housing main body portion 42 when wall member 76 is assembled as depicted in FIGS. 3 and 4. Preferably, flange portions 114 are discontinuous as at 115 and 117 thereby defining spaces which are in alignment, respectively, with guide support grooves 92 and 90 so that when the printed circuit board 100 and the front wall are assembled to the main housing body portion 42, the forward end of such printed circuit board 100 is received within such spaces defined at 115 and 117. Resiliently deflectable latching arms 78 and 80 are also preferably integrally formed with wall member 76 as to be extending rearwardly therefrom.

The free end of arm 78 is provided with a forwardly disposed cam like surface 116 and a rearwardly situated step, latching or abutment surface 118. Similarly, the free end of arm 80 is provided with a forwardly disposed cam like surface 120 and a rearwardly situated step, latching or abutment surface 122. A pair of journal or pivot support members 124 and 126 are also preferably integrally formed with wall member 76 as to extend rearwardly therefrom. Such pivot support members 124 and 126 are respectively provided with pivot recesses or apertures 128 and 130 and are somewhat resiliently deflectable from each other for a purpose to be explained.

The switching lever means 86 is illustrated as comprising a lever portion 132 integrally formed with a main body portion 134 which at its upper and lower ends is respectively provided with pivot members or portions 136 and 138 respectively pivotally received in apertures 128 and 130 of journal supports 124 and 126.

Figure 7:
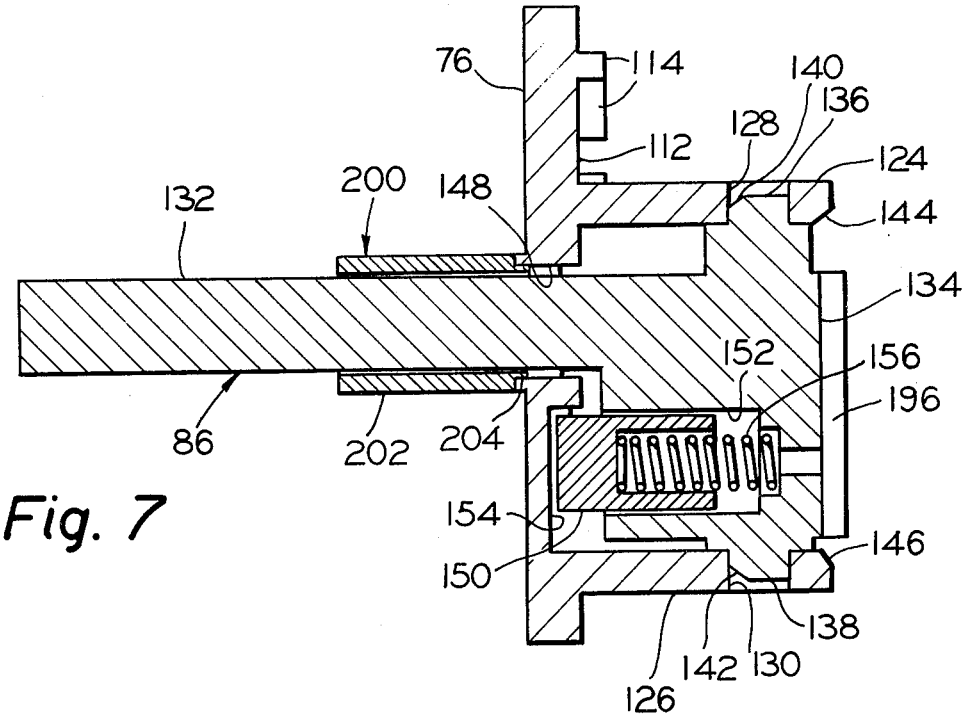
FIG. 7 is a cross-sectional view taken generally on the plane of line 7—7 of FIG. 6 and looking in the direction of the arrows.

As best seen in each of FIGS. 6 and 7, a portion of each of pivots 136 and 138 is chamfered as at 140 and 142 while a coacting portion of each of journal supports 124 and 126 is also chamfered as at 144 and 146. By providing such chamfers and providing for a degree of resilient deflection in journal arms or supports 124 and 126 it then becomes possible to assemble switch member body 134 to forward wall member 76 merely by bringing chamfers 140 and 144 into operative engagement and simultaneously bringing chamfers 142 and 146 into cooperative engagement and then pushing the switch body 134 toward the front wall member 76 causing the upper and lower journal supports 124 and 126 to resiliently deflect away from each other until such time as pivots 136 and 138 are respectively aligned for reception within apertures or pivot recesses 128 and 130 at which time the journal support arms 124 and 126, in effect, snap back toward each other to the position depicted in FIGS. 6 and 7. As best seen in FIG. 7, an aperture 148 formed in the forward wall member 76 accommodates the passage therethrough of lever portion 132.

The switch body 134 is formed with a recess 152 which, in turn, slidably receives a plunger-like member 150 and resilient or spring means 156 resiliently urging the plunger 150 against cooperating detent recess means 154 formed as in the front wall member 76. As will become evident, plunger 150 serves to resiliently urge body 134 and lever 132 to a neutral position as depicted in, for example, FIGS. 3 and 5.

Figure 8:
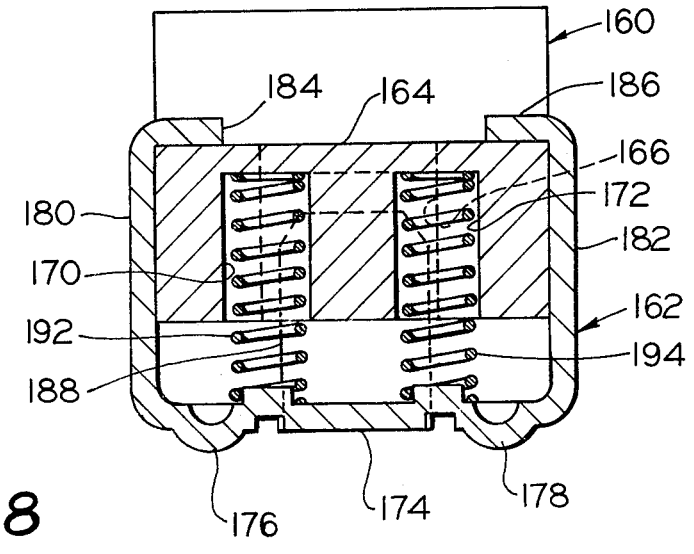
FIG. 8 is a relatively enlarged cross-sectional view taken generally on the plane of line 8—8 of FIG. 5 and looking in the direction of the arrows.

Switch body 134, as depicted in FIGS. 3, 5 and 6, has an integrally formed arm portion 158, provided as with a gusset 159, extending generally laterally of body 134, terminating in a body-like portion 160 carrying electrically conductive contact means 162. As can be seen in FIGS. 5, 6 and 8, contact carrying body 160 is provided with a generally transversely extending slot 164 along with two recess-like or pocket portions 166 and 168, situated generally at opposite sides of the slot 164, as well as two recesses 170 and 172. The contact means 162 is illustrated as preferably comprising a lower disposed bridging-like contact portion 174 having downwardly depending integrally formed contacting portions 176 and 178, spaced from each other, with such portion 174, in turn, having integrally formed arm-like portions 180 and 182 which are closely formed about the exterior of contact body 160 and which have their respective upper ends 184 and 186 bent generally toward each other as to be movably confined within slot 164. A second pair of guide-like arms 188 and 190 are integrally formed as with the medial portion of bridging contact portion 174, at opposite sides thereof, and are respectively slidably received within guide like recesses 166 and 168. A pair of springs 192 and 194, respectively received in recesses 170 and 172, operatively engage the bridging-like portion 174 of contact means 162 as to continually resiliently urge such bridging portion 174 and contacting portions 176 and 178 away from the contact carrying body 160.

Preferably the entire switch member 86, comprising lever 132, body 134, arm 158 and contact carrying body 160, is molded of a dielectric translucent material so that the lever 132 will exhibit a lens-like glow as when a source of light is placed as at the opposite end thereof as, for example, near the opposite end of body 134. In order to enhance the light gathering qualities of the body 134 for transmission through lever 132, the rear or inner-most surface 196 of body 134 is preferably formed as to be of a trough-like or cylindrical-sector configuration thereby presenting an effectively enlarged light-gathering surface to the related light source to be described.

In the preferred embodiment of the invention, the switch lever member 132 is provided with a shield member 200 comprising a tubular portion 202 and a generally rectangular portion 204 which is bowed as to have a curvilinear configuration when viewed as in FIG. 5. As best seen in FIGS. 9, 11 and 12, the front wall or cover member 76 has a preferably cylindrical wall surface portion 206 through which is formed the relatively elongated aperture 148 and which extends into pocket-like chambers 208 and 210 situated generally on either side of the aperture 148. The shield 200 is generally tightly received onto lever 132, as by a frictional engagement of the lever 132 within tubular portion 202, and when assembled, as generally depicted in FIG. 5, the inner arcuate surface 212 of curved portion 204 is brought into juxtaposition with surface 206 thereby effectively closing or covering the space which may exist as between the limits of aperture 148 and the lever 132 passing therethrough. As lever 132 is rotated generally counterclockwise about the axis of pivot 136 in FIG. 5, the curved portion 204 of shield member 200 would travel about the curved surface 206 generally toward pocket 210 (shown in FIG. 12). As lever 132 is rotated generally clockwise about the axis of pivot 136 in FIG. 5, the curved portion 204 of shield member 200 would travel about the curved surface (FIG. 12) generally toward pocket 208. In each of such travels the arcuate length of curved portion 204 is sufficient to maintain aperture 148 covered.

FIG. 10 also illustrates in greater detail a preferred form of the recess detent means 154 which, as depicted therein, comprises oppositely inclined ramp-like surfaces 212 and 214 for engaging the detent plunger 150 and resiliently urging switch means 86 to a position whereat plunger 150 is disposed between such surfaces 212 and 214.

Figure 13:
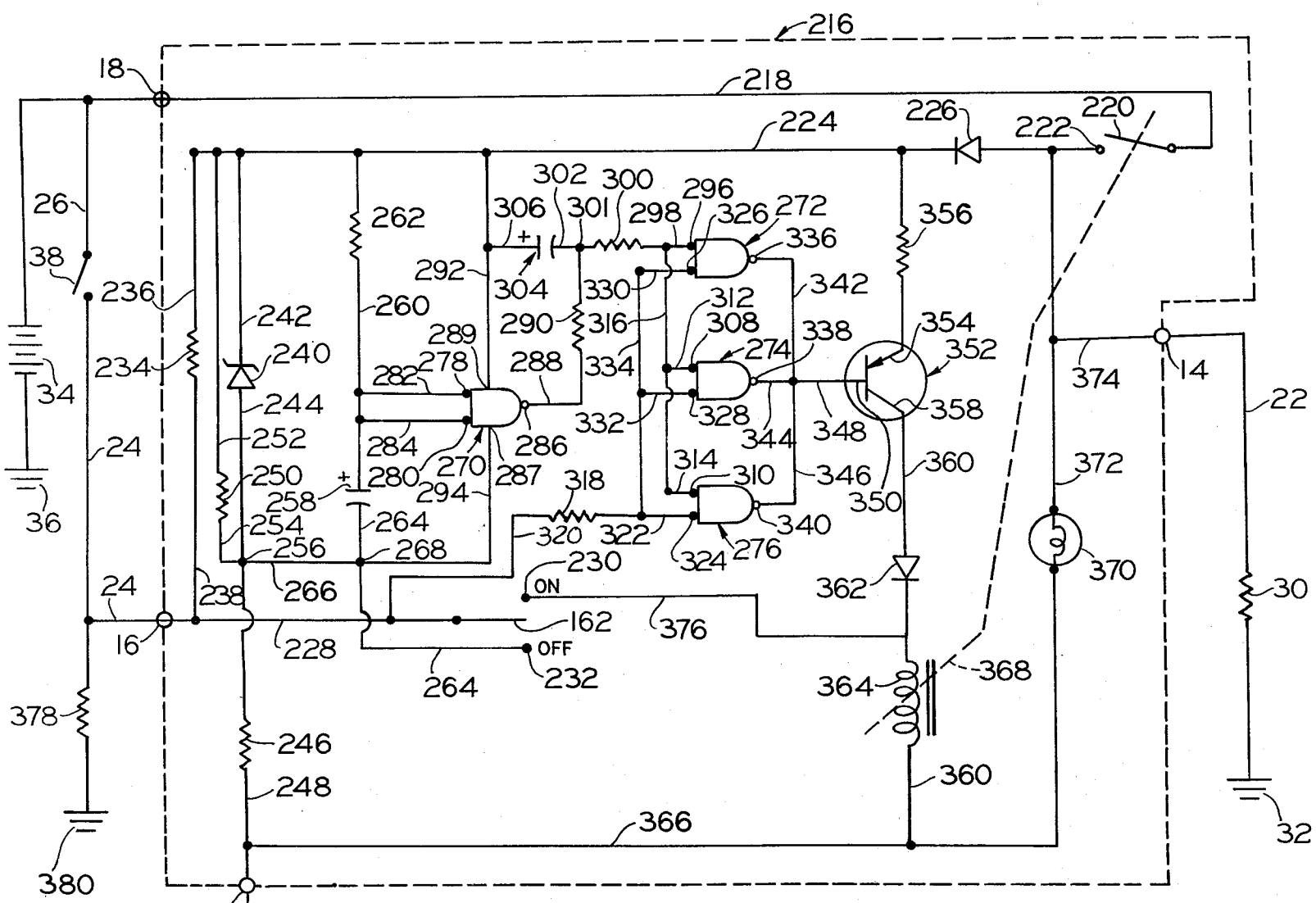
FIG. 13 is a schematic wiring diagram of circuitry employable in practicing the invention.

FIG. 13 illustrates, schematically, circuitry employable in practicing the invention. The circuitry 216 is illustrated as comprising conductor means 218 electrically interconnecting terminal 18 with one side of a relay operated normally open switch member 220 effective when closed as against contact 222 as to thereby complete a circuit therethrough and to a conductor means 224 electrically connected to contact 222 and serially containing a diode 226 therein.

Terminal 16 is electrically connected as by conductor means 228 with manually actuatable switch means 162 which, when moved to an up position (as viewed in FIG. 13), electrically closes against contact 230 and when to a down position electrically closes against contact means 232.

A first resistance 234, as via conductor means 236 and 238, is placed electrically across conductors 224 and 228. A zener diode 240, electrically connected to conductor means 224 as by a conductor 242, is electrically connected via conductor means 244 to resistance means 246 which, in turn, is electrically connected as via conductor means 248 to terminal 12 and ground 28. A resistance 250 is connected via conductor means 252 to conductor 224 and, via conductor 254, to conductor means 244 as at a point 256 generally between zener 240 and resistance 246.

A capacitor 258 has its one electrical side electrically connected as via conductor means 260 and resistance means 262 to conductor 224 while its other electrical side is electrically connected via conductor means 264 to switch contact means 232. A conductor 266 electrically interconnects conductors 244 and 264 as by being electrically connected thereto respectively at 256 and 268.

Elements 270, 272, 274 and 276 comprise a "Quad 2-Input NAND Gate" with each of such elements comprising an integrated circuit. In actual practice, the elements 270, 272, 274 and 276 are integrated into a single component so that the required internal power when supplied to one of the elements is also supplied to the remaining elements via internal circuitry. Gate 270 has both of its input terminals 278 and 280 respectively electrically connected as via conductors 282 and 284 to conductor 260 as between resistor 262 and capacitor 258 while its output terminal 286 is electrically connected via conductor means 288 to resistor means 290. The power supply to gate 270 (and therefore gates 272, 274 and 276) is provided as via conductor means 292 electrically connected to conductor means 224 and conductor means 294 electrically connected to as to point 256 of conductor means 244 as through conductor means 266.

Gate 272 has its input terminal 296 electrically connected as via conductor means 298 to a resistor 300 which, in turn, as through conductor means 302 is electrically connected to one electrical side of a capacitor 304 which has its other electrical side connected as via conductor means 306 to conductor means 292. As depicted, the other electrical end of resistor 290 is electrically connected to conductor means 302 as at a point between capacitor 304 and resistor 300. Input terminals 308 and 310, respectively, of gates 274 and 276 are electrically connected, as via conductor means 312, 314 and 316 to conductor means 298 as at a point generally between terminal 296 of gate 272 and resistor 300.

A resistor 318, which is connected at one end via conductor means 320 to conductor means 228, is electrically connected at its other end via conductor means 322 to input terminal 324 of gate 276. Input terminals 326 and 328, respectively, of gates 272 and 274 are electrically connected, as via conductor means 330, 332 and 334 to conductor means 322 as at a point generally between terminal 324 of gate 276 and resistor 318.

The output terminals 336, 338 and 340 of gates 272, 274 and 276, respectively, are electrically connected as via conductor means 342, 344 and 346 to conductor means 348 leading to the base terminal 350 of a PNP transistor 352 which has its emitter 354 electrically connected to conductor 224 as via series resistor means 356 and its collector 358 in circuit with conductor means 360, serially containing diode means 362 and relay coil means 364, leading to conductor means 366. The energization of relay coil means 364 causes closure of relay contact means 220 and 222 as generally depicted by the dash line 368. As can be seen, one end of conductor means 366 is electrically connected to conductor means 248 while the other end is electrically connected to bulb means 370. The other electrical side of bulb means 370 is electrically connected to conductor means 224 as via conductor 372. The output terminal 14 may be electrically connected as to conductor means 372 as by conductor means 374. The switch contact 230 is electrically connected as by conductor means 376 to conductor means 360 as at a point generally between diode 362 and relay coil 364.

The related vehicular accessory electrical load (or loads) is depicted as resistance means at 378 electrically connected at one end as to conductor means 24 and electrically connected as at its other end to ground 380.

Figure 14:
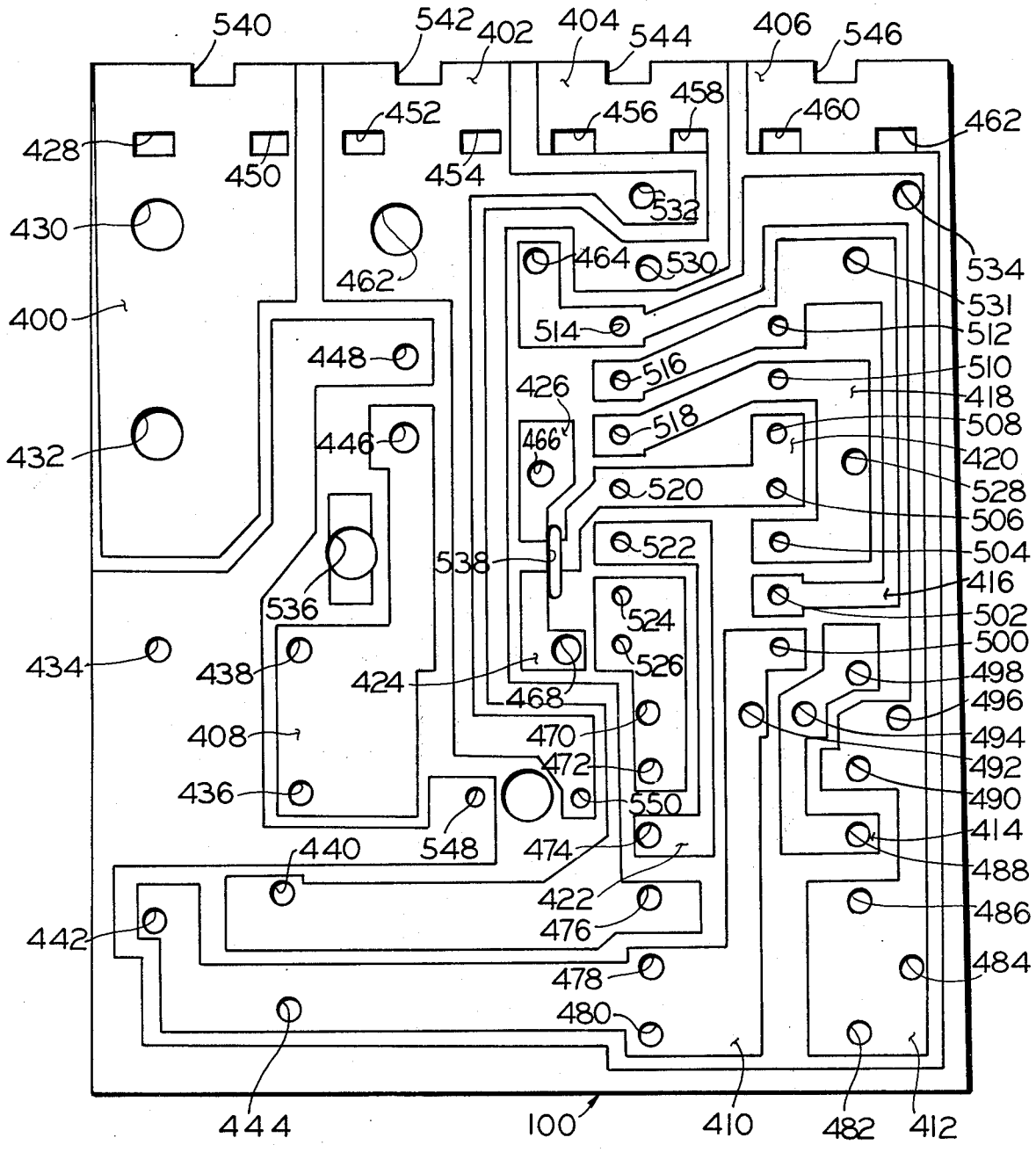
FIG. 14 is a relatively enlarged view of the printed circuit portion of the printed circuit board employable in the invention.

FIG. 14 illustrates the reverse or printed circuit side of the printed circuit board 100 of FIG. 3. As depicted, a plurality of electrically conductive printed circuit portions 400, 402, 404, 406, 408, 410, 414, 416, 418, 420, 422, 424 and 426 through which are formed, as depicted, apertures 428, 430, 432, 434, 436, 438, 440, 442, 444, 446, 448, 450, 452, 454, 456, 458, 460, 462, 464, 466, 468, 470, 472, 474, 476, 478, 480, 482, 484, 486, 488, 490, 492, 494, 496, 498, 500, 502, 504, 506, 508, 510, 512, 514, 516, 518, 520, 522, 524, 526, 528, 530, 531, 532, 534, 548 and 550. Additionally, apertures as at 536 and 538 are provided and notches 540, 542, 544 and 546 are formed.

In comparing FIGS. 3 and 14, terminal 12 has its tabs inserted into 546, 460 and 462 as to be in electrical contact with printed circuit portion 406. Terminal 14 has its tabs inserted into 456, 458 and 544 as to be in electrical contact with printed circuit portion 404. Terminal 16 has its tabs inserted into 452, 454, and 542 as to be in electrical contact with printed circuit portion 402 while terminal 18 has its tabs inserted into 428, 450 and 540 as to be in electrical contact with printed circuit portion 400.

In comparing FIGS. 13 and 14, the plus (+) side of relay coil means 364 is inserted into aperture 446 while the negative (−) or ground side thereof is inserted into aperture 448. The plus (+) side of diode 362 is inserted into aperture 468 while the negative (−) side thereof is inserted into aperture 438. The emitter 354 of transistor 352 is inserted through aperture 538 and brought into electrical contact with printed circuit portion 426, the collector thereof is also inserted through aperture 538 and brought into electrical contact with printed circuit portion 424 while the base 350 thereof is inserted through aperture 538 and brought into electrical contact with printed circuit portion 420.

Two pins formed on the frame of the relay assembly are inserted through respective apertures 430 and 432 as to be in circuit with the source of electrical potential through printed circuit portion 400 while a third pin or leg is inserted through electrically isolated aperture 536. The relay contact 222 has its lead through aperture 462 as to be in circuit with portion 402. The indicator lamp 370 has its opposite leads inserted through apertures 548 and 550 as to be in electrical circuit with portions 406 and 402. The Quad 2-input Gate 270, 272, 274 and 276 has its leads or terminals 326, 296, 336, 338, 308, 328, 327, 278, 280, 286, 340, 310, 324 and 289 respectively received through apertures 512, 510, 508, 506, 504, 502, 500, 526, 524, 522, 520, 518, 516 and 514 as to be in circuit with the printed circuit portions generally circumscribing such apertures. Diode 226 has its plus (+) side inserted through aperture 532 while its negative (−) side is inserted through aperture 534. Resistor 356 has one electrical end inserted through aperture 466 while its other electrical end is inserted through aperture 468.

Resistor 318 has its electrical ends respectively inserted through apertures 530 and 531. Resistor 290 has its opposite electrical ends respectively inserted through apertures 474 and 488. Capacitor 304 has its negative (−) side lead inserted through aperture 494 while its positive (+) side lead is inserted through aperture 496. Resistor 300 has its opposite electrical ends respectively inserted through apertures 498 and 528. Resistor 262 has its electrical ends respectively inserted through apertures 472 and 490 while capacitor 258 has its positive (+) side lead inserted through aperture 492 and its negative (−) side lead inserted through aperture 470. Zener diode 240 has its positive (+) and negative (−) leads respectively inserted through apertures 484 and 478. Resistor 250 has its electrical leads respectively inserted through apertures 410 and 482 while resistor 234 has its electrical leads respectively inserted through apertures 476 and 486. Resistor 246 has its electrical leads respectively inserted through apertures 434 and 442. Further, rivet-like electrical terminals or contacts 552, 554 and 556 (shown in FIG. 3 and effective for securing an electrically dielectric platform member 558 to the component side of the printed circuit board 100) are respectively received through apertures 436, 440 and 440. Contact 552 is functionally equivalent to contact 230 shown in FIG. 13; contact 554 is functionally equivalent as to conductor means 228 of FIG. 13 and contact 556 is functionally equivalent to contact 232 of FIG. 13. Of course, as is well known in the art, the various inserted electrical leads, etc., are electrically connected to the associated printed circuit portion as by, for example, soldering.

Operation of Invention

Generally, as viewed in, for example, FIG. 1, when the switch lever means 86 is actuated to the position depicted at 86-1, the entire circuitry and system becomes energized and, if during such time of energization the switch control means 86 is actuated to the position depicted at 86-2, the entire circuitry and system becomes de-energized.

More specifically, referring to FIG. 13, and assuming the vehicular ignition switch means 38 to be closed, to start the operation of the invention, switch control means 86 is actuated causing switch movable contact means 162 to momentarily close against contact 230 thereby supplying electrical power to relay coil means 364 and consequently moving relay movable contact means 220 closed against fixed contact means 222 thereby completing a circuit through conductor means 218, 372 and 374 and diode 226 to conductor means 224. This, in turn, means that the indicator lamp means 370 as well as the related vehicular backlight or rear window heater means 30 are energized.

Zener diode 240 provides for a substantially constant and fixed voltage reference as across conductor means 224 and 266 which, in the embodiment under consideration is 6.8 volts. As can be seen, the 6.8 volts is applied to the integrated circuit means 270, 272, 274 and 276 as by conductor means 292, 294 and associated terminals 289 and 287. Initially, upon switch contact 220 closing, capacitor 258 has no charge on it and begins to charge through resistor 262 only upon such initial closure of contact means 220 and 222. During the time that capacitor is thusly charging relatively "low" signals are applied, via conductor means 282 and 284 to respective input terminals 278 and 280 of inverter 270 thereby producing a relatively "high" output at terminal 286 of the inverter 270. The "high" voltage output at 286 is applied to resistor 290 and since capacitor 304 is also, initially, discharged, the relatively "high" voltage signal remains "high" with the result that no charging of the capacitor 304 takes place. The "high" voltage signal as then exists as at point 301 is applied via resistor 300 and conductor means 298 to the input terminal 296 of inverter 272 and, simultaneously, via conductor means 316, 312 and 134 is also applied to input terminals 308 and 310 of integrated circuit portions or inverters 274 and 276, respectively. Also, at this time, since the vehicular ignition switch 38 has been assumed closed, a circuit is completed from conductor 24 to conductors 228 and 320, resistor 318 and via conductor 322 to input terminal 324 of inverter 276 thereby placing a "high" signal on input 324. Simultaneously, via conductor means 334, 332 and 330 the same "high" signal is applied to input terminals 328 and 326 of inverters 274 and 272, respectively.

Consequently, with all of the inputs of inverters 272, 274 and 276 experiencing a "high" signal, the respective output terminals 336, 338 and 340 will each produce a "low" output signal which is transmitted via conductor means 348 to the base terminal 350 of PNP transistor 352 thereby placing transistor 352 into conduction so that current flow passes through resistor 356, emitter 354, collector 358, diode 362 relay coil means 364 and to ground 28 as through conductor means 360, 366, and 20. The turning-on of transistor 352 serves to maintain relay coil means 364 energized and relay switch contact means 220, 222 closed even when the manually actuatable switch contact means 162 is, after momentarily closing against contact 230, moved to an open position with respect thereto.

During this time capacitor 258 is undergoing charging and when the charge thereacross reaches a value of approximately six-tenths of the voltage across the integrated circuit (as supplied via conductors 292, 294) the value of the voltage on conductor 260 and conductors 282 and 284 becomes sufficient to serve as a "high" signal and such is applied to both input terminals 278 and 280 of inverter 270 thereby causing the output thereof at output terminal 286 to become "low". This "low" signal then permits capacitor 304 to undergo charging the rate of which is controlled by resistor 290. When capacitor 304 is sufficiently charged point 301 will appear as a "low" voltage signal which is applied as via resistor 300 and conductor means 298, 316, 312 and 314 to input terminals 296, 308 and 310 of inverters 272, 274 and 276, respectively. At this time it can be seen that input terminals 326, 328 and 324 of inverters 272, 274 and 276 are experiencing a "high" signal while the coacting input terminals 296, 308 and 310 have a "low" signal. Consequently, with unlike signals on respective ones of the coacting pairs of input terminals, the output at terminals 336, 338 and 340 will become "high" and such is, in turn, effective for turning-off transistor 352 as to terminate conduction therethrough de-energizing relay coil means 364 and opening relay contact means 220 and 222 which removes or terminates current flow to the indicator lamp 370 and load 30. In the above circuit description, it can be seen that the timing means comprises capacitor means 258 and resistor means 262. In one successful embodiment of the invention, capacitor 258 and resistor 262 were selected as to provide for a 10.0 minute time span after initial closure of the manually actuatable switch contact means 162 and before subsequent de-energization of the transistor 352 and consequent opening of relay contact means 220 and 222.

Now, let it be assumed that the circuitry described has been energized as already described but that the timing means has not yet caused the opening of relay contact means 220 and 222. If at this time the manually actuatable switch contact means 162 is moved to a closed position against terminal 232, the relatively "high" voltage signal from conductor 24 is applied via conductor means 228, 264 and 294 to terminal 287 of the integrated circuitry thereby, in effect, placing terminals 289 and 287 at generally the same voltage and effectively removing internal power therefrom and making the integrated circuitry 270, 272, 274 and 276 non-functional resulting in transistor 352 being made non-conductive. As previously described, when transistor is made non-conductive relay coil means 364 is deenergized and relay contact means 220 and 222 are opened.

Further, resistor means 250 is electrically between terminals 289 and 287 of the integrated circuitry as depicted in portion 270 thereof. Internally of the integrated circuit are diodes placed as between each of the input terminals and the positive (+) terminal 289. Consequently, when power is removed from the integrated circuit, the voltage or charge on the capacitor 258 will be reduced because there will be current flow through such internal diodes at the inputs of the integrated circuitry as through terminal 278 to and through terminal 289 through resistor 250 and back to the negative side of capacitor 258. Such comprises the discharge path for the capacitor 258 upon either completion of a timed cycle or upon interruption of the cycle by the momentary closure of switch member 162 against contact 232.

If the circuitry as described above has completed a timed cycle or has had such timed cycle interrupted by the momentary closure of switch contact means 162 and 232, and the ignition switch 38 has remained closed, capacitor 258 will be limited as to the amount of discharge thereof which can occur. This is as a consequence of the voltage divider network comprised of resistors 234, 250 and 246, so that when the ignition switch remains closed and the integrated circuitry is shut-down, in the embodiment under consideration, the capacitor 258 will only discharge approximately halfway. Accordingly, if after the initial cycle of heating the backlight, as via load or heater means 30, for ten minutes, the vehicle operator desires further heating of the backlight and consequently again energizes the circuitry by actuation of the manual switching means, as described, such subsequent heating cycle will last for only in the order of five minutes because the timing capacitor 258 is already approximately still half-charged from the immediately preceeding cycle. Of course, the degree of discharge can be selected by the selection of appropriate values of resistance means 234, 250 and 246. Further, if resistance means 234 should be eliminated from the circuitry, each cycle time would be the same regardless of whether the ignition switch remained closed.

The accessory electrical load 378, usually existing in all vehicles and, if not, such load equivalent to 378 could be made internally of the circuitry 216, provides a further function in cooperation with the ignition switch means 38. That is, when ignition switch 38 is opened, load means 378 causes, via conductor means 24, 228, 320, resistor 318, conductor means 322, 334, 332 and 330, input terminals 324, 328 and 326 to appear as having "low" signal voltages thereby, as previously described, causing "high" outputs at 336, 338 and 340 and turning-off transistor 352. This assures that upon engine shut-down, as indicated by the opening of the ignition switch 38, the relay contact means will be opened and no power will be taken as from the associated vehicular storage battery.

In one particularly successful embodiment of the invention, the following elements had the respectively indicated values:

Resistor 234: ¼watt; 5.6K
Resistor 250: ¼watt; 1.2K
Resistor 246: ½watt; 120 ohms
Resistor 262: ¼watt; 2.4 Meg.
Resistor 300: ¼watt; 1.2K
Resistor 290: ¼watt; 100K
Resistor 318: ¼watt; 100K
Resistor 356: ¼watt; 10 ohms Integrated circuit portions 270, 272, 274 and 276 were actually comprised of a type MC14011UB, quad 2-input "NAND" gate (with internal diodes), manufactured by Motorola Semiconductor Products, Inc. and described as at Page 7–32 in the publication entitled "Motorola CMOS Integrated Circuits" and bearing a U.S. of America copyright notice by Motorola, Inc. 1978; transistor means 352 was type MPS-D55-PNP manufactured by Motorola Semiconductor Products, Inc. and described in the publication entitled "The Semiconductor Data Library, Series A, Volume 3" and bearing a U.S. of America copyright notice by Motorola, Inc., 1974; capacitor 258 was 220 at 16 volts; capacitor 304 was 47 at 10 volts; zener diode 240 was type 1N5235A and diodes 226 and 362 were type 1N4001.

If further clarification is needed, terminals 326, 296, 336, 338, 308, 328, 287, 280, 286, 340, 310, 324 and 289 correspond respectively to pins or terminals 1, 2, 3, 4, 5, 6, 7, 8, 9, 10, 11, 12, 13 and 14 of the said quad 2-input "NAND" gate as depicted in on said Page 7–32 of said publication "Motorola CMOS Integrated Circuits".

Figure 15:
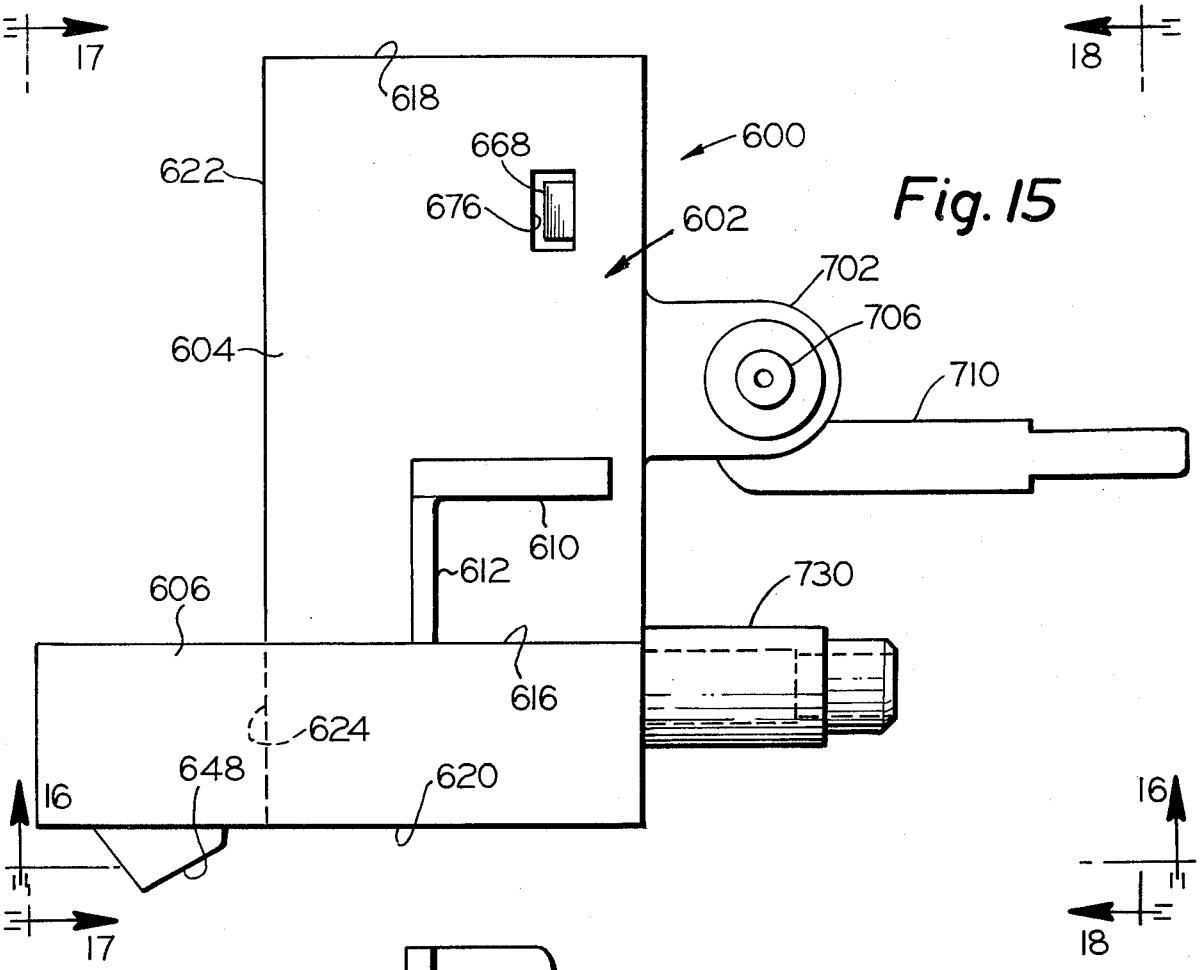
FIG. 15 is, what may be considered as being, a top plan view of another embodiment of the invention.
Figure 16:
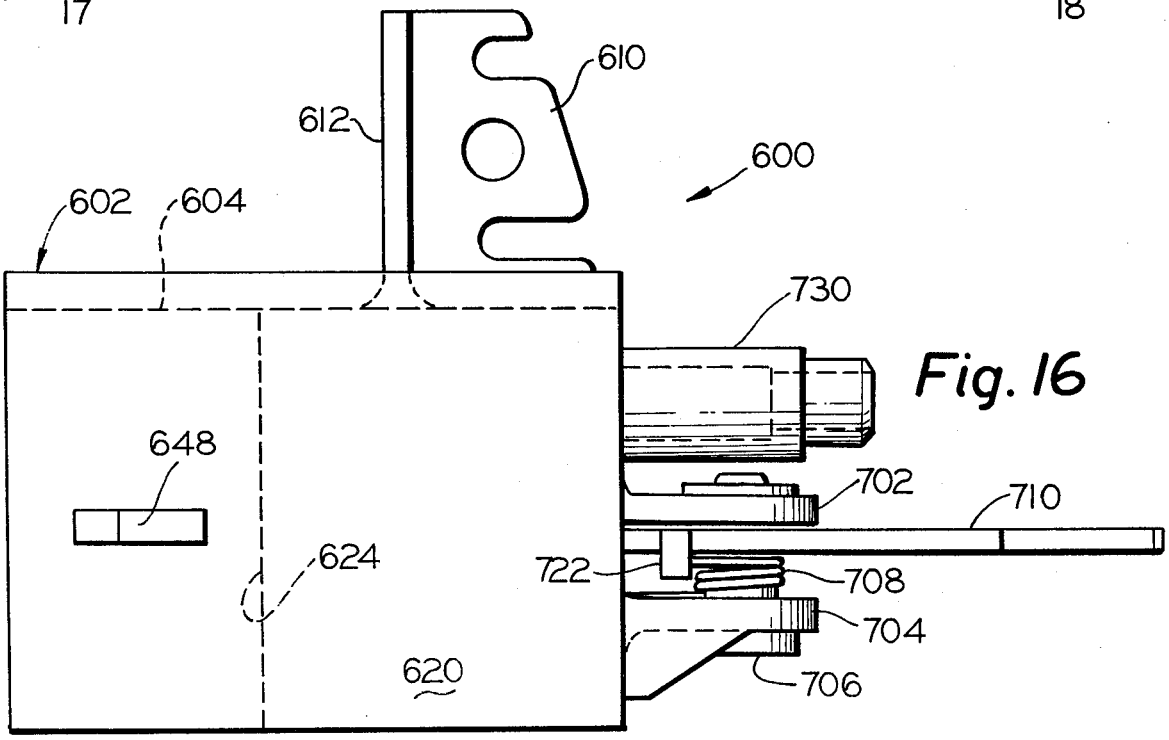
FIG. 16 is a view taken generally on the plane of line 16—16 of FIG. 15 and looking in the direction of the arrows.
Figure 17:
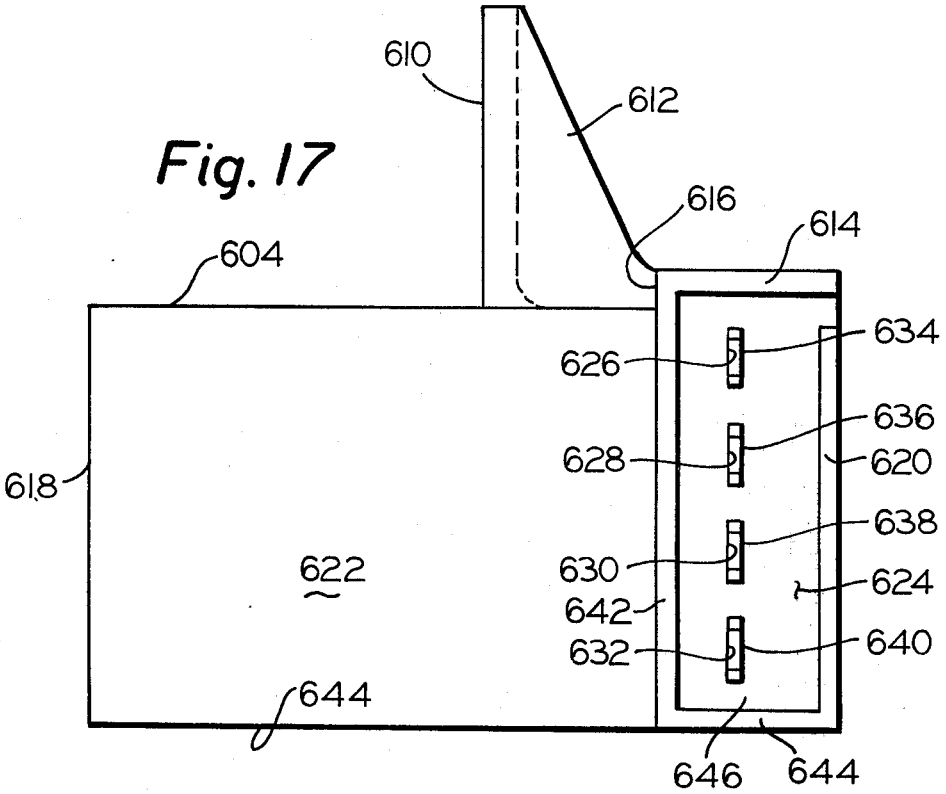
FIG. 17 is a view taken generally on the plane of line 17—17 of FIG. 15 and looking in the direction of the arrows.

Now referring first to FIGS. 15, 16 and 17, a second embodiment 600 of the invention is illustrated as comprising housing means 602 having, generally first and second housing sections or portions 604 and 606 which are preferably integrally molded with each other. The top or upper wall 608 of housing section 604 carries a mounting bracket 610 reinforced as by a gusset 612. As can be seen in each of FIGS. 15, 16, 17 and 18, upper wall 614 of housing portion 606 is at an elevation higher than upper wall 608 and such are integrally joined by a generally vertically extending side wall portion 616.

One side wall 618 of the housing means 602 is carried by housing portion 604 while the opposite side wall 620 is formed by housing portion 614. As shown in FIGS. 15 and 17, the rear wall 622 of housing section 604, effectively, extends through housing section 606 to define a wall portion 624 through which are formed a plurality of apertures 626, 628, 630 and 632 for the respective reception therethrough of electrical terminals 634, 636, 638 and 640. As best seen in FIGS. 17 and 19, side walls 622 and 642, bottom wall 644 and upper wall 614 of housing section 606 effectively extend rearwardly defining a generally hooded or recess like area 646 in which are situated the extending electrical terminals. In practice, such extension is adapted to cooperatively join with related electrical terminal assembly means which will complete circuits with terminal members 634, 636, 638 and 640 and which can be detachably latched as to cooperating latching or tab-like abutment means 648 carried as by wall 620. As best illustrated in FIGS. 17 and 18, the bottom wall 644 of housing portion 606 may in fact be an extension of and part of the bottom wall of housing portion 604.

Figure 18:
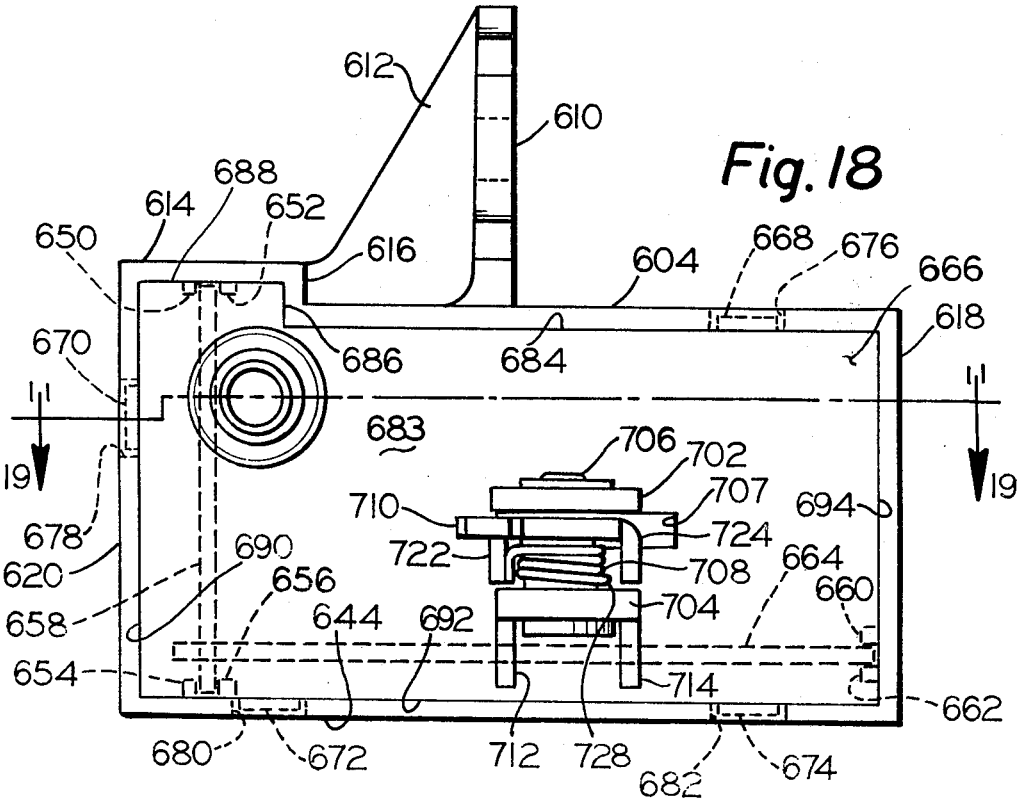
FIG. 18 is a view taken generally on the plane of line 18—18 of FIG. 15 and looking in the direction of the arrows.
Figure 19:
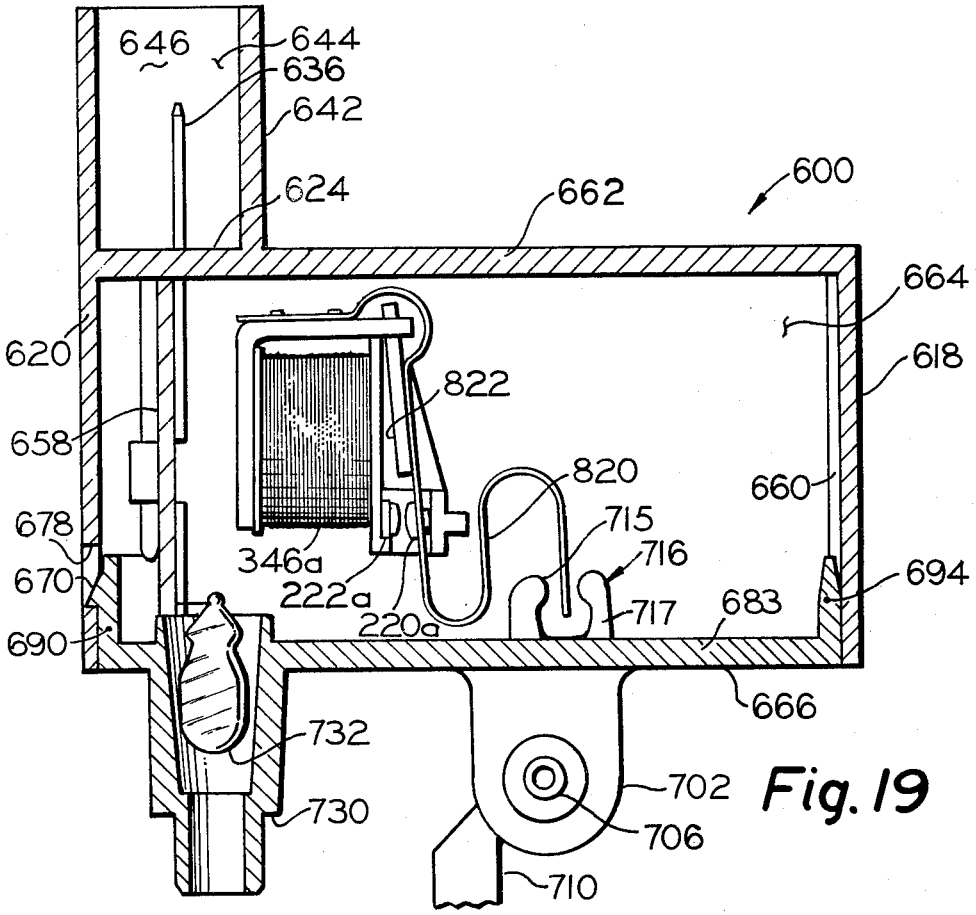
FIG. 19 is a cross-sectional view taken generally on the plane of line 19—19 of FIG. 18 and looking in the direction of the arrows.
Figure 20:
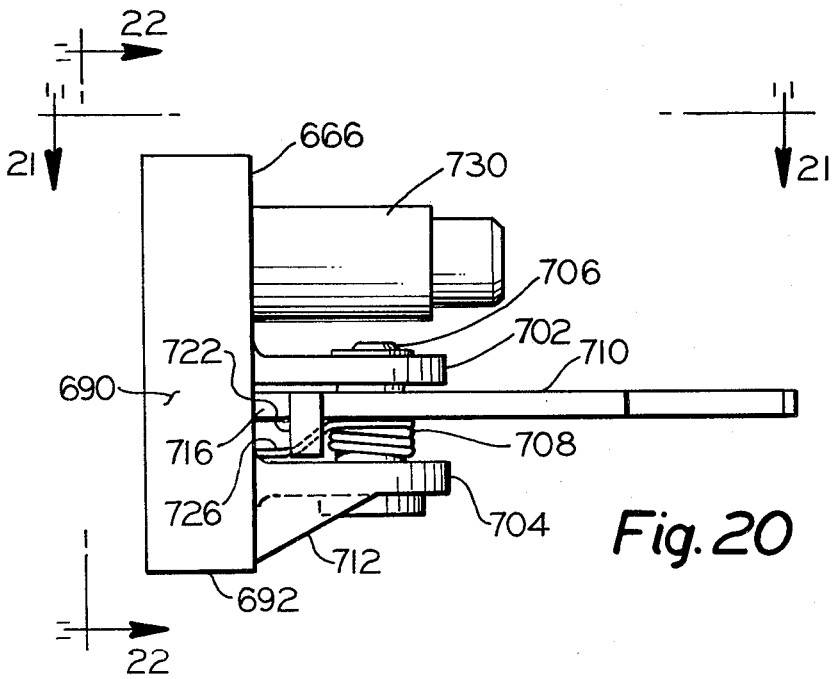
FIG. 20 is a view of a sub-assembly with such view being similar to that of FIG. 16.
Figure 21:
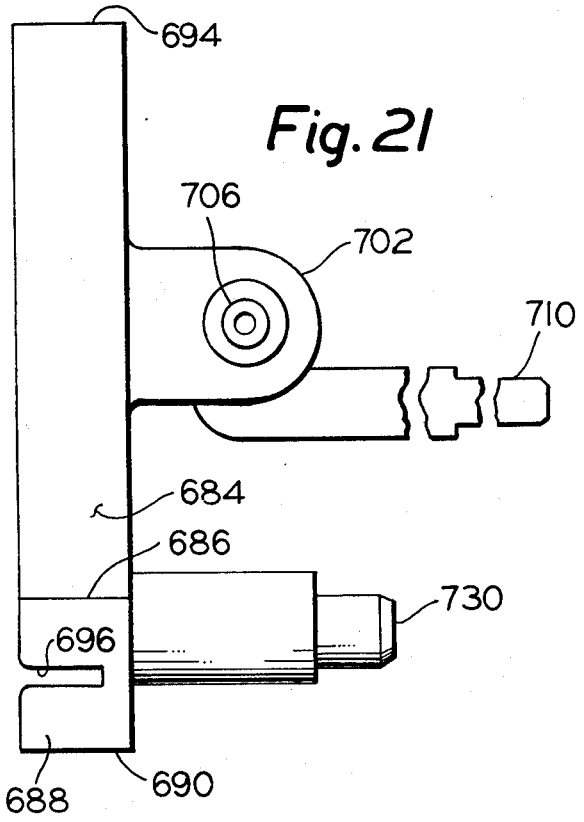
FIG. 21 is a view taken generally on the plane of line 21—21 of FIG. 20 and looking in the direction of the arrows.

As generally depicted in FIGS. 18 and 19, the inner surface of upper wall portion 614 is provided with a pair of spaced longitudinally extending flange-like portions 650 and 652 while, in general vertical alignment, the inner surface of lower wall portion 644 is provided with a pair of spaced longitudinally extending flange-like portions 654 and 656. Each of such coacting pairs of flange-like portions define a guide and supporting slot which, in turn, closely receives and supports a side edge of a related printed circuit board 658. Somewhat similarly, the inner surface of end or side wall 618 is provided with a pair of spaced longitudinally extending flange-like portions 660 and 662 which cooperate to define a guide and supporting slot therebetween closely receiving and supporting one end of a second printed circuit board 664. The opposite end of the printed circuit board 664, as will become evident, is in electrical contact with and supported by printed circuit board 658.

As generally depicted in FIG. 18, and somewhat in FIG. 15, a front wall or cover member 666, closely received within the corresponding opening of housing portions 604 and 614, has a plurality of ear or tab-like portions 668, 670, 672 and 674 which, by resilient deflection, are insertable within cooperating openings or recesses 676, 678, 680 and 682 formed in walls 604, 620 and 644. When thusly inserted and operatively engaged, the front wall or cover 666 becomes detachably secured in assembled relationship to the remaining portion of the housing means 602.

As can be seen in FIGS. 15–22 the forward wall or cover 666 is comprised of a generally forwardly situated transverse wall portion 683 having integrally formed rearwardly extending side walls 684, 686, 688, 690, 692 and 694 with side walls 688 and 692 being respectively provided with slots 696 and 698 for accommodating therein a portion of printed circuit board 658 and with sidewall 694 being provided with a similar slot 700 for accommodating a portion of printed circuit board 664.

Generally forwardly of transverse wall 683 are integrally formed and outwardly extending pivot or journal support members 702 and 704 cooperatively serving to support a pivot pin 706 which, in turn, locates a torsion spring 708 and pivotally secures a manually actuatable switch lever 710. Suitable reinforcing gussets may be provided as at 712 and 714 for journal support 704. Aperture means 707 is formed through transverse wall 683 as to both permit the extension of a portion of lever means 710, namely, lever arm 716, therethrough as well as to provide anchor means for spring means 708.

As generally depicted in FIGS. 16, 18, 20 and 22, lever arm 716 is provided with depending abutment portions 718 and 720 situated at the outside of spring arms 726 and 728 which are, in turn, contained as within portions 722 and 724 of aperture means 707.

Also, as best shown in FIGS. 15, 16, 18, 19, 20, 21 and 22, the forward generally transverse wall portion 683 also has an integrally formed forwardly extending tubular portion 730 which is preferably adapted to receive therein an indicator bulb 732 as to indicate by the emission of light therefrom that the invention has been activated.

Figure 23:
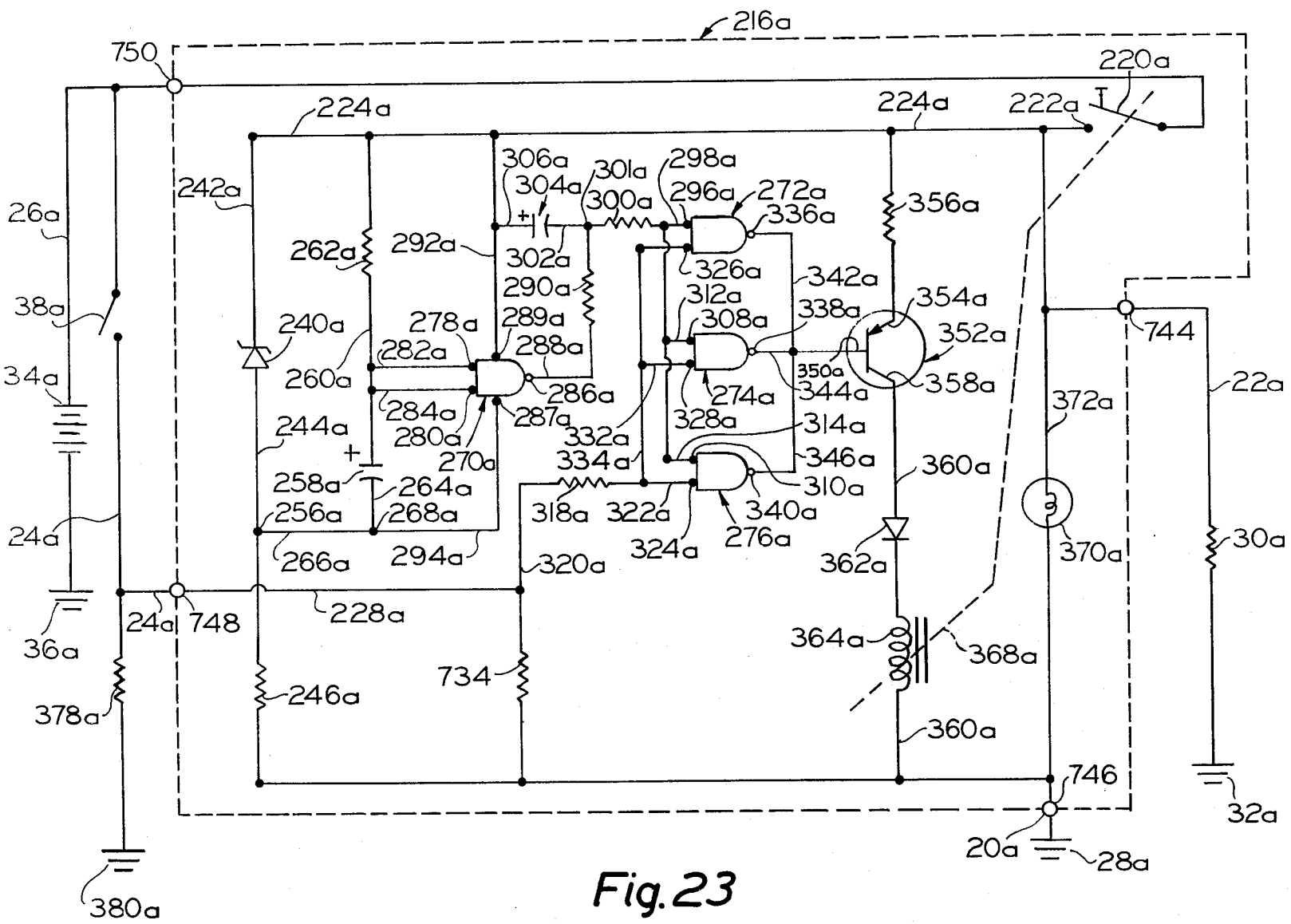
FIG. 23 is a schematic wiring diagram of circuitry employable in the practice of the second embodiment of the invention.

FIG. 23 schematically illustrates circuitry employable in practicing the invention of the second embodiment. All elements like or similar to those of FIG. 13 are identified with like reference numbers provided with a suffix "a". The operation of the circuitry of FIG. 23 is as described with reference to FIG. 13; however, in the embodiment of FIG. 23, resistance means equivalent to resistors 234 and 250 of FIG. 13 are omitted thereby resulting in every cycle time being equal regardless of whether the ignition switch **38*a* remains closed. Further, circuit means 216*a* is also provided with additional internal resistance means 734 for use in those events where an external accessory load as represented at 378*a* may not be present for purposes previously discussed with reference to FIG. 13**.

As generally discussed and as generally depicted in, for example, FIG. 19, the circuitry of FIG. 23 is carried by two cooperating printed circuit boards 658 and 664. As shown in enlarged view printed circuit board 658 is illustrated as comprising or carrying, at the underside thereof, printed circuit portions 736, 738, 740 and 742 with electrical terminals 744, 746, 748 and 750 mounted at the opposite side of the printed circuit board 658 and being respectively secured thereto as by tabs 752, 754, 756 and 758 as to thereby place such terminals in respective electrical engagement with such printed circuit portions. The bulb 732 has its respective opposite terminals electrically connected to printed circuit portions 736 and 738.

A generally rectangular aperture 760 is formed through board 658 as to be in close proximity to portions 739 and 741 of printed circuit portions 738 and 740, respectively. Preferably, bodies of terminals 744 and 750 are respectively provided with upstanding tabs 762 and 764, respectively, of which the lower edges 766 and 768 are generally coplanar with edge 770 of aperture 760. Further, preferably, body 772 of terminal 744 is also provided with a second upstanding tab 774 which has its surface 776 generally coplanar with edge 778 of aperture 760. When the two printed circuit boards 658 and 664 are brought together edges 768, 766 and 774 tend to contain the printed circuit board 664 therebetween.

Figure 25:
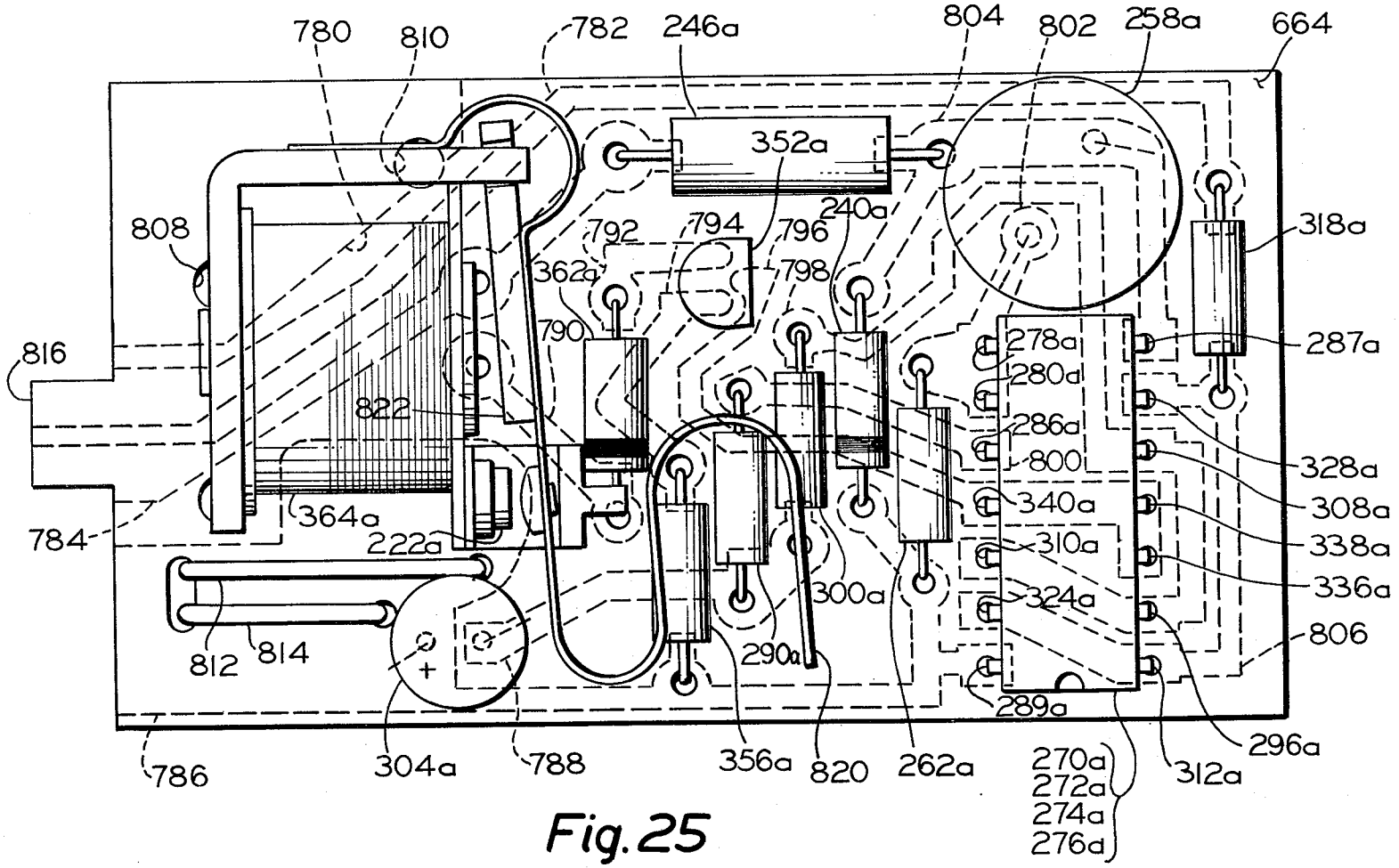
FIG. 25 is a relatively enlarged plan view of another printed circuit board employable in the practice of the second embodiment of the invention.

FIG. 25 illustrates the printed circuit board 664 as comprising a plurality of printed circuit portions 780, 782, 784, 786, 788, 790, 792, 794, 796, 798, 800, 802, 804 and 806. The frame of relay assembly (comprising contacts **22*a* and 220*a* and coil 364*a*) is electrically connected as at 808 and 810 of printed circuit portion 780; the coil 364*a* has its opposite terminals connected to printed circuit portions 784 and 790. The various other electrical components are situated and electrically connected to the related printed circuit portions as depicted. If a resistor as 734 is to be employed, such would be electrically connected across printed circuit portions 782 and 784. Further, in the preferred arrangement, jumper-like conductors 812 and 814 are provided to enhance the current carrying capacity of printed circuit portion 786. As illustrated in FIG. 25, a projection 816 of the board 664 carries extensions of the printed circuit portions 782 and 784**.

Figure 24:
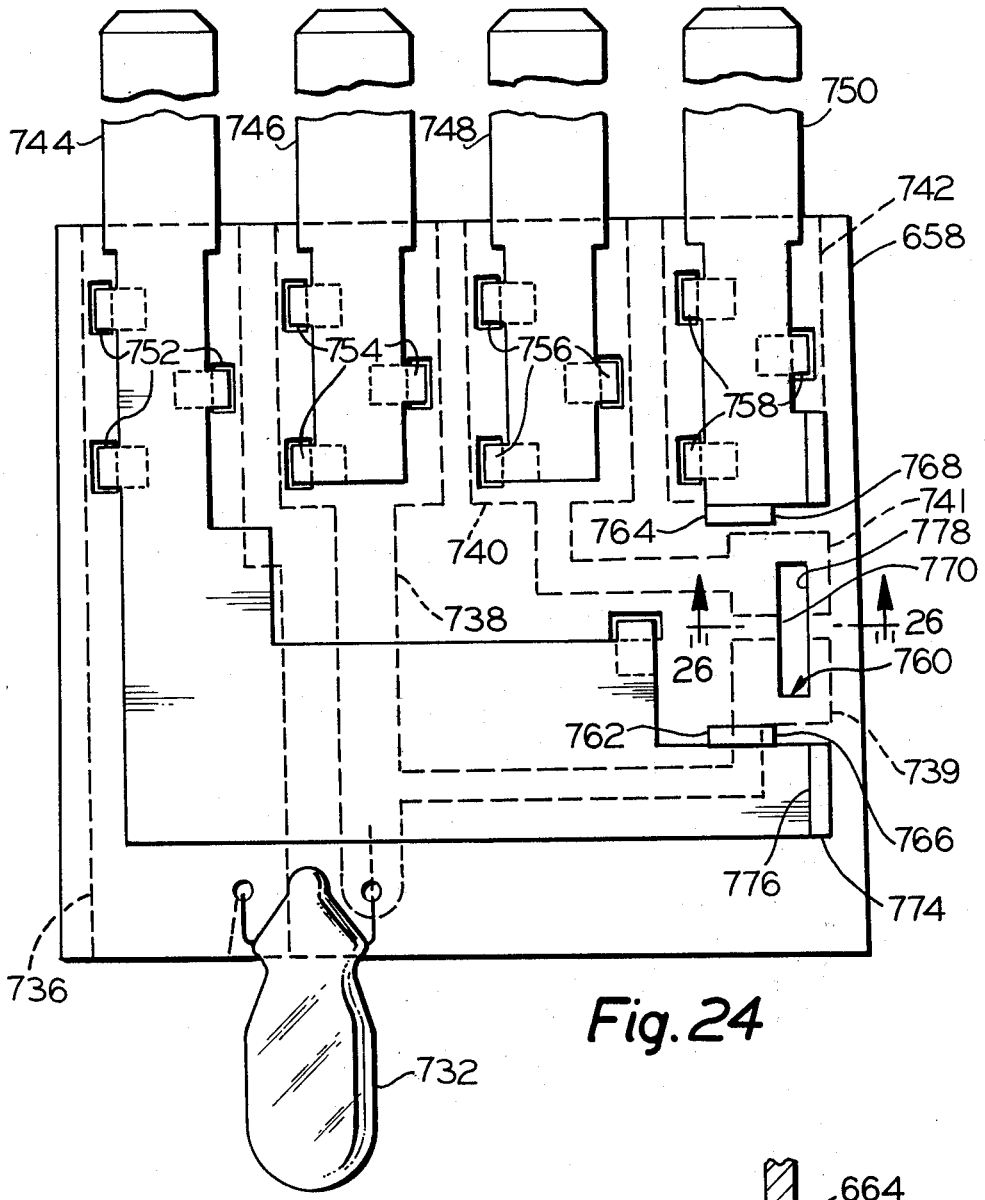
FIG. 24 is a relatively enlarged plan view of one of the printed circuit boards employable in the practice of the second embodiment of the invention.
Figure 26:
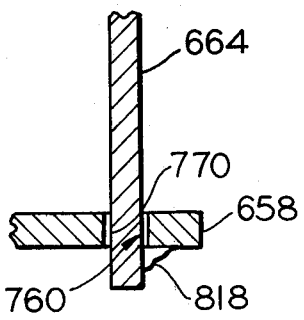
FIG. 26 is a fragmentary cross-sectional view taken generally on the plane of line 26—26 of FIG. 24 and looking in the direction of the arrows.

In assembling the boards 658 and 664, projection 816 is closely received through aperture 760 of board 658 (FIG. 24) and solder or the like is applied, as generally depicted at 818 of FIG. 26) as to thereby complete electrical circuits as between printed circuit portion 740, 741 of board 658 and printed circuit portion 782 of board 664 and well as between printed circuit portion 738, 739 of board 658 and printed circuit portion 784 of board 664.

When assembled, as generally depicted in FIG. 19, as lever 710 is rotated, against the resilient resistance of spring means 708, counter-clockwise about pivot 706, arm 716 through engagement with spring-like extension 820 of the armature 822, of the relay, moves contact 220*a* against contact 222*a* as to energize the coil 364*a* and the related circuitry as previously described with reference to FIG. 13. The contacts 220*a* and 222*a* will remain closed even though the lever 710 is released to return to its null position shown in FIG. 19 because of the energization of coil 364*a* and the lost motion within the elements 820 and 716. If the circuit is to be deenergized before the expiration of the timing cycle, lever 710 is rotated clockwise about pivot 706 and lever arm 716 engages and moves extension 820 sufficiently to the right as to forcibly open contacts 220*a* and 222*a* thereby de-energizing the circuitry.

Figure 27:
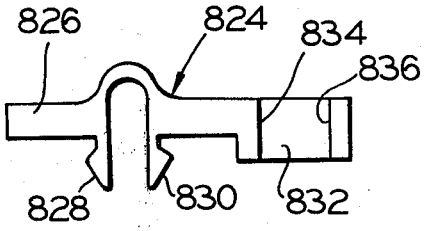
FIG. 27 is a relatively enlarged elevational view of another element which may be employed in a modified form of the invention.
Figure 22:
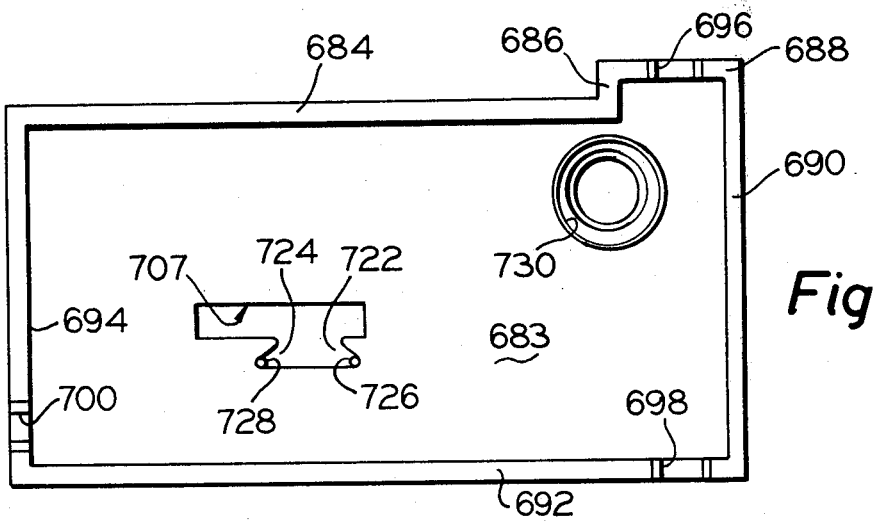
FIG. 22 is a view taken generally on the plane of line 22—22 of FIG. 20 and looking in the direction of the arrows.

FIG. 27 illustrates in relatively enlarged scale, a slide 824 which may be detachably secured to lever arm 716 (FIG. 19) and which, when thusly secured, will slide transversely across the inner surface of cover wall 683 to actuate the contact 220*a*. That is, as depicted the slide 824 comprises a main body 826 having a pair of depending legs 828 and 830 resiliently deflectable toward each other as to be received between the arm portions 715 and 717 of lever arm 716 and to be secured snapped therebetween. At an end of body 826 is a recess 832 defined as by opposed wall portions or surfaces 834 and 836. When such slide 824 is employed in combination with lever arm 716, it is possible to change the configuration of the extension 820 to one which is, effectively, a straight extension of the armature 822 and to have the end of such straight extension received within the confines of walls 834 and 836 for actuation thereby.

Although only two preferred embodiments and selected modifications of the invention have been disclosed and described, it is apparent that other embodiments and modifications of the invention are possible within the scope of the appended claims.

What is claimed is:

1. An electrical switching and timing assembly, comprising first switch means selectively electrically closable and openable, circuit means having an input end and an output end, said input end being adapted for electrical connection to a master switch assembly and through said master switch assembly to a source of electrical potential, said output end being adapted for electrical connection to associated electrical load means, said circuit means being closable by selective closing of said first switch means only if said selective closing of said first switch means occurs when said master switch assembly is closed, said circuit means comprising electrical timing means effective for opening said circuit means within a first preselected span of time after said circuit means is first closed by said first switch means, said electrical timing means also being effective for opening said circuit means within a second predetermined span of time after the expiration of said first preselected span of time and upon said circuit means being again closed by said first switch means, said second preselected span of time being different from said first preselected span of time, and wherein said first switch means is effective for opening said circuit means even before the expiration of either of said preselected spans of time.

2. An electrical switching and timing assembly according to claim 1 wherein said first switch means comprises a switch member, said switch member having at least first and second switch positions, said switch member when moved to said first switch position being effective only if said master switch assembly is closed for closing said circuit means and energizing said electrical timing means, said switch member being in a null condition when in said second switch position.

3. An electrical switching and timing assembly according to claim 2 and further comprising an electrically energiziable light generating source, said light generating source being electrically energized to produce a light signal whenever said circuit means is closed.

4. An electrical switching and timing assembly according to claim 2 and further comprising an electrically energizable light generating source, wherein said switch member is of at least translucent material, said light generating source being electrically energized to produce a light signal whenever said circuit means is closed, and wherein said light signal is transmitted through said translucent material comprising said switch member.

5. An electrical switching and timing assembly according to claim 1 wherein said first switch means comprises a switch member, said switch member having at least first and second switch positions, said switch member when moved to said first switch position being effective only if said master switch assembly is closed for closing said circuit means and energizing said electrical timing means, said switch member when moved to said second switch position being effective to open said circuit means prior to the expiration of either of said preselected spans of time.

6. An electrical switching and timing assembly according to claim 5 and further comprising an electrically energizable light generating source, said light generating source being electrically energized to produce a light signal whenever said circuit means is closed.

7. An electrical switching and timing assembly according to claim 5 and further comprising an electrically energizable light generating source, wherein said switch member is of at least translucent material, said light generating source being electrically energized to produce a light signal whenever said circuit means is closed, and wherein said light signal is transmitted through said translucent material comprising said switch member.

8. An electrical switch and timing assembly according to claim 7 and further comprising resilient means, said resilient means being effective to move said switch member to a third null condition whenever said switch member is manually moved to said first position and released.

9. An electrical switching and timing assembly according to claim 5 and further comprising resilient means, said resilient means being effective to move said switch member to a third null condition whenever said switch member is manually moved to said second switch position and released.

10. An electrical switching and timing assembly according to claim 5 and further comprising resilient means, said resilient means being effective to move said switch member to a third null condition whenever said switch member is manually moved to said first switch position and released.

11. An electrical switching and timing assembly according to claim 10 wherein said resilient means is also effective to move said switch member to said third null condition whenever said switch member is manually moved to said second switch position and released.

12. An electrical switching and timing assembly according to claim 1 wherein said second preselected span of time is less than said first preselected span of time.

13. An electrical switching and timing assembly, comprising first switch means selectively electrically closable and openable, circuit means having an input end and an output end, said input end being adapted for electrical connection to a master switch assembly and through said master switch assembly to a source of electrical potential, said output end being adapted for electrical connection to associated electrical load means, said circuit means being closable by selective closing of said first switch means only if said selective closing of said first switch means occurs when said master switch assembly is closed, said circuit means comprising electrical timing means effective for opening said circuit means within a preselected span of time after said circuit means has been closed by said first switch means, said electrical timing means also being effective for opening said circuit means within a second preselected span of time after the expiration of said first preselected span of time and upon said circuit means being again closed by said first switch means, said second preselected span of time being different from said first preselected span of time, and wherein said first switch means is effective for opening said circuit means even before the expiration of either of said preselected spans of time, said first switch means comprising a switch member, said switch member having at least first second and third switch positions, said switch member when moved to said first switch position being effective only if said master switch assembly is closed for closing said circuit means and energizing said electrical timing means, said switch member when moved to said second switch position being effective to open said circuit means prior to the expiration of either of said preselected spans of time, said switch member being in a null condition when in said third switch position.

14. An electrical switching and timing assembly according to claim 13 and further comprising an electrically energizable light generating source, said light generating source being electrically energized to produce a light signal whenever said circuit means is closed.

15. An electrical switching and timing assembly according to claim 13 and further comprising an electrically energizable light generating source, wherein said switch member is of at least translucent material, said light generating source being electrically energized to produce a light signal whenever said circuit means is closed, and wherein said light signal is transmitted through said translucent material comprising said switch member.

16. An electrical switching and timing assembly according to claim 13 and further comprising resilient means, said resilient means being effective to move said switch member to said null condition whenever said switch member is manually moved to said first switch position and released.

17. An electrical switching and timing assembly according to claim 13 wherein said resilient means is also effective to move said switch member to said third null condition whenever said switch member is manually moved to said second switch position and released.

18. The combination of an automotive vehicle and a backlight heater and timing control means, wherein said vehicle comprises a backlight with electrically energizable heater means associated therewith and vehicle-engine energizing switch means, and wherein said backlight heater and timing control means comprises an electrical switching and timing assembly, said electrical switching and timing assembly comprising second switch means selectively manually actuatably closable and openable, said second switch means being electrically closable only during such times as said vehicle-engine energizing switch means is closed, circuit means having an input end and an output end, said input end being electrically connected to said vehicle-engine energizing switch means and through said vehicle-engine energizing switch means to a source of electrical potential, said output end being operatively electrically connected to said heater means, said circuit means comprising electrical timing means effective for opening said circuit means upon the expiration of a preselected span of time after said circuit means has been closed by said second switch means, and wherein with said vehicle-engine energizing switch means remaining closed after the expiration of said preselected span of time and said circuit means being closed for a second time by said second switch means said timing means being effective to again open said circuit means upon the expiration of a second preselected span of time after said circuit means has been closed for said second time by said second switch means, said second preselected span of time being less than the first mentioned span of time.

19. The combination according to claim 18 wherein said second switch means comprises a switch member, said switch member having at least first and second switch positions, said switch member when moved to said first switch position being effective only if said vehicle-engine energizing switch means is closed for closing said circuit means and energizing said electrical timing means, said switch member being in a null condition when in said second switch position.

20. The combination according to claim 19 and further comprising an electrically energizable light generating source, said light generating source being electrically energized to produce a light signal whenever said circuit means is closed.

21. The combination according to claim 19 and further comprising an electrically energizable light generating source, wherein said switch member is of at least translucent material, said light generating source being electrically energized to produce a light signal whenever said circuit means is closed, and wherein said light signal is transmitted through said translucent material comprising said switch member.

22. The combination according to claim 18 wherein said second switch means comprises a switch member, said switch member having at least first and second switch positions, said switch member when moved to said first switch position being effective only if said vehicle-engine energizing switch means is closed for closing said circuit means and energizing said electrical timing means, said switch member when moved to said second switch position being effective to open said circuit means prior to the expiration of either of said preselected spans of time.

23. The combination according to claim 22 and further comprising an electrically energizable light generating source, said light generating source being electrically energized to produce a light signal whenever said circuit means is closed.

24. The combination according to claim 22 and further comprising an electrically energizable light generating source, wherein said switch member is of at least translucent material, said light generating source being electrically energized to produce a light signal whenever said circuit means is closed, and wherein said light signal is transmitted through said translucent material comprising said switch member.

25. The combination according to claim 18 wherein said second switch means comprises a switch member, said switch member having at least first second and third switch positions, said switch member when moved to said first switch position being effective only if said vehicle-engine energizing switch means is closed for closing said circuit means and energizing said electrical timing means, said switch member when moved to said second switch position being effective to open said circuit means prior to the expiration of either of said preselected spans of time, said switch member being in a null condition when in said third switch position.

26. The combination according to claim 25 and further comprising an electrically energizable light generating source, said light generating source being electrically energized to produce a light signal whenever said circuit means is closed.

27. The combination according to claim 25 and further comprising an electrically energizable light generating source, wherein said switch member is of at least translucent material, said light generating source being electrically energized to produce a light signal whenever said circuit means is closed, and wherein said light signal is transmitted through said translucent material comprising said switch member.

28. The combination according to claim 18 and further comprising housing means, said housing means comprising first second third and fourth side walls collectively forming a chamber between inner surfaces thereof, said chamber having first and second ends, said first end being fixedly closed by first end wall means, support means carried by at least certain of said inner surfaces of said side walls, printed circuit board means carried by said support means as to be disposed within said chamber, wherein said printed circuit board means carries said circuit means said timing means and a first portion of said second switch means, and second end wall means effective for closing said second end, said second end wall means also carrying a second portion of said second switch means, said first end wall means being integrally formed with said side walls, said second end wall means being detachably secured to at least certain of said side walls.

29. The combination according to claim 28 wherein said input end of said circuit means comprises a plurality of electrical contact terminals carried by said printed circuit board means, and a plurality of access passages formed through said first end wall means for enabling the extension therethrough of said contact terminals for operative electrical connection to said vehicle-engine energizing switch means.

30. The combination according to claim 28 wherein said input end of said circuit means comprises first electrical contact terminals carried by said printed circuit board means, first access passage means formed through said first end wall means for enabling electrical connection between said vehicle-engine energizing switch means and said first electrical contact terminals, wherein said output end of said circuit means comprises a second electrical contact terminal carried by said printed circuit board means, and second access passage means formed through said first end wall means for enabling electrical connection between said heater means and said second electrical contact terminal.

31. The combination according to claim 30 wherein said first portion of said second switch means comprises at least first and second fixed electrical contact means carried by said printed circuit board means, and wherein said second portion of said second switch means comprises lever means operatively pivotally secured to said second end wall means, said lever means comprising movable electrical contact means movable with said lever means, said movable electrical contact means being effective to at times electrically close with said at least first and second fixed contact means.

32. The combination according to claim 31 and further comprising detent means, said detent means comprising a first detent portion carried by said lever means, and a second detent portion carried by said second end wall means.

33. The combination according to claim 32 wherein one of said first and second detent means is resiliently deflectable.

34. The combination according to claim 33 wherein said first detent portion comprises a resiliently biased movable detent member, and wherein said second detent portion comprises recess-like means for receiving said detent member.

35. An electrical switching and timing assembly, comprising first switch means selectively electrically closable and openable, circuit means having an input end and an output end, said input end being adapted for electrical connection to a master switch assembly and through said master switch assembly to a source of electrical potential, said output end being adapted for electrical connection to associated electrical load means, said circuit means being closable by selective closing of said first switch means only if said selective closing of said first switch means occurs when said master switch assembly is closed, said circuit means comprising electrical timing means effective for opening said circuit means within a preselected span of time after said circuit means has been closed by said first switch means, wherein said first switch means is effective for opening said circuit means even before the expiration of said preselected span of time, housing means, said housing means comprising first second third and fourth side walls collectively forming a chamber between inner surfaces thereof, said chamber having first and second ends, said first end being fixedly closed by first end wall means, support means carried by at least certain of said inner surfaces of said side walls, printed circuit board means carried by said support means as to be disposed within said chamber, wherein said printed circuit board means carries said circuit means said timing means and a first portion of said first switch means, and detachable second end wall means effective for closing said second end, said second end wall means also carrying a second portion of said first switch means.

36. An electrical switching and timing assembly according to claim 35 wherein said first end wall means is integrally formed with said side walls.

37. An electrical switching and timing assembly according to claim 35 wherein said second end wall means is detachably secured to certain of said side walls.

38. An electrical switching and timing assembly according to claim 35 wherein said first end wall means is integrally formed with said side walls, and wherein said second end wall is detachably secured to certain of said side walls.

39. An electrical switching and timing assembly according to claim 35 wherein said input end of said circuit means comprises a plurality of electrical contact surfaces carried by said printed circuit board means, and a plurality of access passages formed through said first end wall means for enabling electrical connection between said master switch assembly and said electrical contact surfaces.

40. An electrical switching and timing assembly according to claim 35 wherein said input end of said circuit means comprises a plurality of electrical contact terminals carried by said printed circuit board means, and a plurality of access passages formed through said first end wall means for enabling the extension therethrough of said contact terminals for operative electrical connection to said master switch assembly.

41. An electrical switching and timing assembly according to claim 35 wherein said input end of said circuit means comprises first contact surface means carried by said printed circuit board means, first access passage means formed through said first end wall means for enabling electrical connection between said master switch assembly and said first contact surface means, wherein said output end of said circuit means comprises second contact surface means carried by said printed circuit means, and second access passage means formed through said first end wall means for enabling electrical connection between said load means and said second contact surface means.

42. An electrical switching and timing assembly according to claim 35 wherein said input end of said circuit means comprises first electrical contact terminals carried by said printed circuit board means, first access passage means formed through said first end wall means for enabling electrical connection between said master switch assembly and said first electrical contact terminals, wherein said output end of said circuit means comprises a second electrical contact terminal carried by said printed circuit board means, and second access passage means formed through said first end wall means for enabling electrical connection between said load means and said second electrical contact terminal.

43. An electrical switching and timing assembly according to claim 42 wherein said first electrical contact terminals extend through said first access passage means, and wherein said second electrical contact terminal extends through said second access passage means.

44. An electrical switching and timing assembly according to claim 35, wherein said first portion of said first switch means comprises at least first and second fixed electrical contact means carried by said printed circuit board means, and wherein said second portion of said switch means comprises lever means operatively pivotally secured to said second end wall means, said lever means comprising movable electrical contact means movable with said lever means, said movable electrical contact means being effective to at times electrically close with said at least first and second fixed electrical contact means.

45. An electrical switching and timing assembly according to claim 44 and further comprising detent means, said detent means comprising a first detent portion carried by said lever means, and a second detent portion carried by said second end wall means.

46. An electrical switching and timing assembly according to claim 45 wherein one of said first and second detent means is resiliently deflectable.

47. An electrical switching and timing assembly according to claim 44 wherein said first detent portion comprises a resiliently biased movable detent member, and wherein said second detent portion comprises recess-like means for receiving said detent member.

48. An electrical switching and timing assembly according to claim 44 wherein said first detent portion comprises a plunger-like detent member, wherein said second detent portion comprises first and second ramp-like surfaces inclined with respect to each other and extending toward each other, groove means formed generally between said ramp-like surfaces, and further comprising spring means operatively engaging said plunger-like detent member and urging said plunger-like member in a direction generally toward said ramp-like surfaces as to be at times in contact with said ramp-like surfaces, wherein the angle of contact between said plunger-like member and said first ramp-like surface being such as to result in a reaction force created by said spring means tending to move said plunger-like member toward said groove means and said second ramp-like surface, and wherein the angle of contact between said plunger-like member and said second ramp-like surface being such as to result in a reaction force created by said spring means tending to move said plunger-like member toward said groove means and said first ramp-like surface.

49. An electrical switching and timing assembly according to claim 48 and further comprising a light generating source, said lever means being comprised at least in part of at least translucent material, and wherein when said circuit means is closed said light generating source is energized as to direct light rays to pass from said light generating source and through said translucent material.

50. An electrical switching and timing assembly according to claim 35 wherein said support means comprises first and second longitudinally extending flange-like portions carried by said first and third walls, wherein said first and second flange-like portions respectively comprise longitudinally extending first and second slots, and wherein said printed circuit board means is slidably received in said first and second slots.

51. An electrical switching and timing assembly according to claim 35 wherein said support means comprises first and second longitudinally extending flange-like portions carried by said first and third walls, wherein said first and second flange-like portions respectively comprise longitudinally extending slots formed therein and situated as to be disposed generally opposed to each other, wherein said second end wall means comprises an inner surface defining the second end of said chamber, wherein said support means comprises a third flange-like portion carried by said second end wall means, wherein said third flange-like portion comprises a third slot extending generally as between said first and second slots, and wherein said printed circuit board means is slidably received in said first second and third slots.

52. The combination of an automotive vehicle and a backlight heater and timing control means, wherein said vehicle comprises a backlight with electrically energizable heater means associated therewith and vehicle-engine energizing switch means, wherein said backlight heater and timing control means comprises an electrical switching and timing assembly, said electrical switching and timing assembly comprising second switch means selectively manually actuatably closable and openable, said second switch means being electrically closable only during such times as said vehicle-engine energizing switch means is closed, circuit means having an input end and an output end, said input end being electrically connected to said vehicle-engine energizing switch means and therethrough to a source of electrical potential, said output end being operatively electrically connected to said heater means, said circuit means comprising electrical timing means effective for opening said circuit means upon the expiration of a first span of time after said circuit means has been closed by said second switch means, and wherein with said vehicle-engine energizing switch means remaining closed after the expiration of said first span of time and said circuit means being closed for a second time by said second switch means said timing means being effective to again open said circuit means upon the expiration of a second span of time after said circuit means has been closed for said second time by said second switch means, said second span of time being of a time span different from said first span of time.

53. The combination according to claim 52 wherein said second switch means comprises a switch member, said switch member having at least first second and third switch positions, said switch member when moved to said first switch position being effective only if said vehicle-engine energizing switch means is closed for closing said circuit means and energizing said electrical timing means, said switch member when moved to said second switch position being effective to open said circuit means prior to the expiration of said first span of time, said switch member being in a null condition when in said third switch position, housing means, said switch member comprising lever means operatively pivotally secured to said housing means, and further comprising detent means, said detent means comprising a first detent portion carried by said lever means, and a second detent portion operatively carried by said housing means.

54. The combination according to claim 53 wherein one of said first and second detent means is resiliently deflectable.

55. The combination according to claim 54 wherein said first detent portion comprises a resiliently biased movable detent member, and wherein said second detent portion comprises recess-like means for receiving said detent member.

56. An electrical switching and timing assembly, comprising first switch means selectively electrically closable and openable, circuit means having an input end and an output end, said input end being adapted for electrical connection to a master switch assembly and through said master switch assembly to a source of electrical potential, said output end being adapted for electrical connection to associated electrical load means, said circuit means being closable by selective closing of said first switch means only if said selective closing of said first switch means occurs when said master switch assembly is closed, said circuit means comprising electrical timing means effective for opening said circuit means within a span of time after said circuit means has been closed by said first switch means, wherein said first switch means is effective for opening said circuit means even before the expiration of said span of time, housing means, said housing means comprising first second third and fourth side walls collectively forming a chamber between inner surfaces thereof, said chamber having first and second ends, said first end being permanently closed by first end wall means, support means generally within said chamber, printed circuit board means carried by said support means as to be disposed within said chamber, wherein said printed circuit board means carries said circuit means said timing means and a first portion of said first switch means, and second end wall means effectively closing said second end, said second end wall means also carrying a second portion of said first switch means.

57. An electrical switching and timing assembly according to claim 56 wherein said first end wall means is integrally formed with said side walls.

58. An electrical switching and timing assembly according to claim 56 wherein said second end wall means is detachably secured to certain of said side walls.

59. An electrical switching and timing assembly according to claim 56 wherein said first end wall means is integrally formed with said side walls, and wherein said second end wall means is detachably secured to certain of said side walls.

60. An electrical switching and timing assembly according to claim 56 wherein said input end of said circuit means comprises a plurality of electrical contact surfaces carried by said printed circuit board means, and a plurality of access passages formed through said first end wall means for enabling electrical connection between said master switch assembly and said electrical contact surfaces.

61. An electrical switching and timing assembly according to claim 56 wherein said input end of said circuit means comprises a plurality of electrical contact terminals operatively connected to said printed circuit board means, and a plurality of access passages formed through said first end wall means for enabling the extension therethrough of said contact terminals for operative electrical connection through said master switch assembly to said source of electrical potential.

62. An electrical switching and timing assembly according to claim 56 wherein said input end of said circuit means comprises first contact surface means carried by said printed circuit board means, first access passage means formed though first end wall means for enabling electrical connection between said source of electrical potential and said first contact surface means, wherein said output end of said circuit means comprises second contact surface means carried by said printed circuit board means, and second access passage means formed through said first end wall means for enabling electrical connection between said load means and said contact surface means.

63. An electrical switching and timing assembly according to claim 56 wherein said input end of said circuit means comprises first electrical contact terminals carried by said printed circuit board means, first access passage means formed through said first end wall means for enabling electrical connection between said master switch assembly and said first electrical contact terminals, wherein said output end of said circuit means comprises a second electrical contact terminal carried by said printed circuit board means, and second access passage means formed through said first end wall means for enabling electrical connection between said load means and said second electrical contact terminal.

64. An electrical switching and timing assembly according to claim 63 wherein said first electrical contact terminals extend through said first access passage means, and wherein said second electrical contact terminal extends through said second access passage means.

65. An electrical switching and timing assembly according to claim 56 wherein said first portion of said first switch means comprises at least first and second fixed electrical contact means carried by said printed circuit board means, and wherein said second portion of said switch means comprises lever means operatively pivotally secured to said housing means, said lever means comprising movable electrical contact means carried by said lever means, said movable electrical contact means being effective to at times electrically close with said at least first and second fixed electrical contact means.

66. An electrical switching and timing assembly according to claim 65 and further comprising detent means, said detent means comprising a first detent portion carried by said lever means, and a second detent portion carried by said housing means.

67. An electrical switching and timing assembly according to claim 66 wherein one of said first and second detent means is resiliently deflectable.

68. An electrical switching and timing assembly according to claim 64 wherein said first detent portion comprises a resiliently biased movable detent member, and wherein said second detent portion comprises recess-like means for receiving said detent member.

69. An electrical switching and timing assembly according to claim 65 wherein said first detent portion comprises a plunger-like detent member, wherein said second detent portion comprises first and second ramp-like surfaces inclined with respect to each other and extending toward each other, groove means formed generally between said ramp-like surfaces, and further comprising spring means operatively engaging said plunger-like member in a direction generally toward said ramp-like surfaces as to be at times in contact with said ramp-like surfaces, wherein the angle of contact between said plunger-like member and said first ramp-like surface being such as to result in a reaction force created by said spring means tending to move said plunger-like member toward said groove means and said second ramp-like surface, and wherein the angle of contact between said plunger-like member and said second ramp-like surface being such as to result in a reaction force created by said spring means tending to move said plunger-like member toward said groove means and said first ramp-like surface.

70. An electrical switching and timing assembly according to claim 69 and further comprising a light generating source, said lever means being comprised at least in part of at least translucent material, and wherein when said circuit means is closed said light generating source is energized as to direct light rays to pass from said light generating source and through said translucent material.

71. An electrical switching and timing assembly according to claim 56 wherein said support means comprises first and second longitudinally extending flange-like portions carried by said first and third walls, wherein said first and second flange-like portions respectively comprise longitudinally extending first and second slots, and wherein said printed circuit board means is slidably received in said first and second slots.

72. An electrical switching and timing assembly according to claim 56 wherein said support means comprises first and second longitudinally extending flange-like portions carried by said first and third walls, wherein said first and second flange-like portions respectively comprise longitudinally extending slots formed therein and situated as to be disposed generally opposed to each other, wherein said second end wall means comprises an inner surface defining the second end of said chamber, wherein said support means comprises a third flange-like portion carried by said second end wall means, wherein said third flange-like portion comprises a third slot extending generally as between said first and second slots, and wherein said printed circuit board means is slidably received in said first second and third slots.

73. The combination of an automotive vehicle and a window heater and timing control means, wherein said vehicle comprises a window with electrically energizable heater means associated therewith and vehicle-engine energizing switch means, and wherein said window heater and timing control means comprises an electrical switching and timing assembly, said electrical switching and timing assembly comprising second switch means selectively manually actuatably closable and openable, said second switch means being electrically closable only during such times as said vehicle-engine energizing switch means is closed, circuit means having an input end and an output end, said input end being electrically connected to said vehicle-engine energizing switch means and through said vehicle-engine energizing switch means to a source of electrical potential, said output end being operatively electrically connected to said heater means, said circuit means comprising electrical timing means effective for opening said circuit means upon the expiration of a span of time after said circuit means has been closed by said second switch means, and wherein with said vehicle-engine energizing switch means remaining closed after the expiration of said span of time and said circuit means being closed for a second time by said second switch means said timing means being effective to again open said circuit upon the expiration of a second span of time after said circuit means has been closed for said second time by said second switch means, said second span of time being of a time span different from the first mentioned span of time.

74. The combination according to claim 73 wherein said second span of time is less than said first mentioned span of time.

75. An electrical switching and timing assembly, comprising first switch means selectively electrically closable and openable, circuit means having an input end and an output end, said input end being adapted for electrical connection to a master switch assembly and through said master switch assembly to a source of electrical potential, said output end being adapted for electrical connection to associated electrical load means, said circuit means being closable by selective closing of said first switch means only if said selective closing of said first switch means occurs when said master switch assembly is closed, said circuit means comprising electrical timing means effective for opening said circuit means within a first span of time after said circuit means is first closed by said first switch means, said electrical timing means also being effective for opening said circuit means within a second span of time after the expiration of said first span of time and upon said circuit means being again closed by said first switch means, said second span of time being substantially equal to said first span of time, and wherein said first switch means is effective for opening said circuit means even before the expiration of either of said spans of time.

76. An electrical switching and timing assembly, comprising first switch means selectively electrically closable and openable; circuit means having an input end and an output end; said input end being adapted for electrical connection to a master switch assembly and through said master switch assembly to a source of electrical potential; said output end being adapted for electrical connection to associated electrical load means; said circuit means being closable by selective closing of said first switch means only if said selective closing of said first switch means occurs when said master switch assembly is closed; said circuit means comprising electrical timing means effective for opening said circuit means within a first span of time after said circuit means has been closed by said first switch means; wherein said first switch means is effective for opening said circuit means even before the expiration of said first span of time; said electrical timing means also being effective for opening said circuit means within a second span of time, after either expiration of said first span of time or the opening of said circuit means by said first switch means prior to the expiration of said first span of time, upon said circuit means being again closed by said first switch means.

77. An electrical switching and timing assembly according to claim 76 wherein said first span of time and said second span of time are substantially equal.

78. An electrical switching and timing assembly according to claim 76 wherein said second span of time is less than said first span of time.

79. The combination of an automotive vehicle and a window heater and timing control means, wherein said vehicle comprises a window with electrically energizable heater means associated therewith and vehicle-engine energizing switch means, and wherein said window heater and timing control means comprises an electrical switching and timing assembly, said electrical switching and timing assembly comprising second switch means selectively manually actuatably closable and openable, said second switch means being electrically closable only during such times as said vehicle-engine energizing switch means is closed, circuit means having an input end and an output end, said input end being electrically connected to said vehicle-engine energizing switch means and through said vehicle-engine energizing switch means to a source of electrical potential, said output end being operatively electrically connected to said heater means, said circuit means comprising electrical timing means effective for opening said circuit means upon the expiration of a first span of time after said circuit means has been closed by said second switch means, with said vehicle-engine energizing switch means remaining closed after the expiration of said first span of time and said circuit means being closed for a second time by said second switch means said timing means being effective to again open said circuit means upon the expiration of a second span of time after said circuit means has been closed for said second time by said second switch means, said vehicle-engine energizing switch means being effective upon being moved to an electrically open condition to open said circuit means even before the expiration of either of said spans of time.

80. Electrical circuit means for use in timed enerization of associated electrical load means, comprising a source of electrical potential, first electrical conductor means electrically connected to said source and adapted for connection to said load means, first normally open electrical contact means in said first electrical conductor means, second electrical conductor means electrically connected to said first conductor means at a point generally between said contact means and said load means, third electrical conductor means electrically connected as between said first conductor means and ground potential, first electrical switch means in said third conductor means, fourth electrical conductor means electrically connected to said third conductor means, fifth electrical conductor means electrically connected to said second conductor and said ground potential, said fifth conductor means comprising transistor means and relay coil means wherein the emitter and collector of said transistor means are in series circuit with said relay coil means, said relay coil means upon energization thereof being effective to close said normally open contact means, sixth electrical conductor means electrically connected to said fifth conductor at a point generally between said transistor and said relay coil means, first gate means having first and second input terminal means and first output terminal means, second gate means having third and fourth input terminal means and second output terminal means, third gate means having fifth and sixth input terminal means and third output terminal means, fourth gate means having seventh and eighth input terminal means and fourth output terminal means, said transistor further comprising base terminal means, said first second and third output terminal means being electrically connected to said base terminal means, said first third and fifth input terminal means being electrically connected to each other and to seventh electrical conductor means, said seventh conductor means also being electrically connected to said fourth output terminal means, said seventh conductor means comprising first and second resistance means, eighth electrical conductor means electrically connected to said second conductor means with said fourth gate as to supply internal power thereto, first capacitor means having a first electrical side thereof electrically connected to said eighth conductor means and having a second electrical side thereof electrically connected to said seventh conductor at a point generally between said first and second resistance means, nineth electrical conductor means electrically connected between said second conductor means and ground potential, said ninth conductor comprising third resistance means and second capacitor means, said seventh and eighth input terminals being electrically connected to said nineth conductor means generally between said third resistance means and said second capacitor means said second fourth and sixth input terminal means being electrically connected to each other and to tenth electrical conductor means, said tenth conductor means being electrically connected to said fourth conductor means and comprising fourth resistance means, eleventh electrical conductor means electrically connected to said nineth conductor means generally between said second capacitor means and ground potential, and second electrical switch means, said second electrical switch means being positionable into any of at least three positions, said second switch means when in a first of said at least three positions being effective to complete an electrical circuit as between said fourth conductor means and said sixth conductor means, said second switch means when in a second of said at least three positions being effective to complete an electrical circuit as between said eleventh conductor means and said fourth conductor means, and said second switch means when in a third of said at least three positions being effective to open the circuit as between said fourth and eleventh conductors and as between said fourth and sixth conductors.

81. An electrical switching and timing assembly, comprising first switch means selectively electrically closable and openable; circuit means having an input end and an output end; said input end being adapted for electrical connection to a source of electrical potential; said output end being adapted for electrical connection to associated electrical load means; said circuit means comprising electrical timing means effective for opening said circuit means within a first span of time after said circuit means has been closed by said first switch means; wherein said first switch means is effective for opening said circuit means even before the expiration of said first span of time; said electrical timing means also being effective for opening said circuit means within a second span of time, after either the expiration of said first span of time or the opening of said circuit means by said first switch means prior to the expiration of said first span of time, upon said circuit means being again closed by said first switch means; housing means; said housing means defining interior chamber means; printed circuit board means situated generally in said chamber means; wherein said printed circuit board means carries at least a substantial portion of said circuit means; wherein said housing means comprises a first housing portion and a second housing portion; wherein said second housing portion is situated generally transverse to said first housing portion; wherein said printed circuit board means comprises a first printed circuit board portion and a second printed circuit board portion; wherein said first printed circuit board portion is situated generally in said first housing portion; wherein said second printed circuit board portion is situated generally in said second housing portion; wherein said second printed circuit board portion is situated generally transverse to said first printed circuit board portion; a first end wall carried by said first housing portion; a second end wall carried by said second housing portion; electrical terminal means electrically connected to said circuit means and extending through said first end wall; wherein said manually actuatable switch means extends through said second end wall; passage means formed through said second end wall; said passage means having its medial axis generally transverse to said second end wall and to said second printed circuit board portion; and lamp means carried by said first printed circuit board portion; said lamp means being in general alignment with said passage means as to emit light through said passage means upon energization; said lamp means being energized upon closing of said circuit means.

82. The combination of an automotive vehicle a window heater and timing control means, wherein said vehicle comprises a window with electrically energizable heater means associated therewith and vehicle-engine energizing switch means, and wherein said window heater and timing control means comprises an electrical switching and timing assembly, said electrical switching and timing assembly comprising load circuit means and timing circuit means, wherein said load circuit means comprises a load circuit input end and a load circuit output end, said load circuit input end being electrically connected to a source of electrical potential, said load circuit output end being electrically connected to said heater means, normally open load switch means situated in series relationship with said load circuit means as to be generally electrically between said source of electrical potential and said heater means, said timing circuit means comprising power supply conductor means effective for providing an electrical potential only when said load switch means is closed, electrical timing means, said timing circuit means further comprising output switch means and inductive coil means electrically connected thereto, said output switch means being normally open as to thereby maintain said inductive coil means normally de-energized, and normally open manually actuated switch means, said manually actuated switch means being electrically connected at one electrical end thereof to said vehicle-engine energizing switch means and through said vehicle-engine energizing switch means to said source of electrical potential, said manually actuated switch means when actuated to an electrically closed condition being effective only when said vehicle-engine energizing switch means is closed to cause said output switch means to become conductive thereby energizing said inductive coil means which closes said normally open load switch means to energize said heater means and simultaneously energize said electrical timing means, said electrical timing means being effective upon the expiration of a first span of time to cause said output switch means to become non-conductive thereby de-energizing said inductive coil means and causing said load switch means to return to its normally open condition, and only with said vehicle-engine energizing switch means remaining closed and said manually actuated switch means again being moved to an electrically closed condition said electrical timing means again being effective upon the expiration of a second span of time to cause said output switch means to again become non-conductive thereby again de-energizing said inductive coil means and causing said load switch means to again return to its normally open condition.

83. The combination according to claim 82 wherein said manually actuated switch means comprises a second closed condition different from the first mentioned electrically closed condition, and wherein said manually actuated switch means when actuated to said second closed condition is effective for causing said output switch means to become non-conductive even before the expiration of either of said spans of time.

84. The combination according to claim 82 wherein said inductive coil means and said load switch means comprise electrically energizable relay means.

85. The combination according to claim 82 wherein said output switch means comprises transistor means.

86. The combination according to claim 82 wherein said timing means comprises analog timing means.

87. The combination according to claim 85 wherein said inductive coil means and said load switch means comprise electrically energizable relay means, and wherein said output switch means comprises transistor means.

88. The combination according to claim 82 wherein said inductive coil means and said load switch means comprise electrically energizable relay means, and wherein said timing means comprises analog timing means.

89. The combination according to claim 82 wherein said inductive coil means and said load switch means comprise electrically energizable relay means, wherein said output switch means comprises transistor means, and wherein said timing means comprises analog timing means.

90. The combination according to claim 82 wherein said output switch means comprises transistor means, and wherein said timing means comprises analog timing means.

91. The combination according to claim 82 wherein said timing circuit means further comprises first, second, third and fourth gate means; wherein said first gate means comprises first and second input terminal means; wherein said second gate means comprises third and fourth input terminal means; wherein said third gate means comprises fifth and sixth input terminal means; wherein said fourth gate means comprises seventh and eighth input terminal means; wherein said first, second, third and fourth gate means respectively comprise first, second, third and fourth output terminal means; wherein said output switch means comprises transistor means having base terminal means; wherein said first, second and third output terminal means are electrically connected to said base terminal means; wherein said second, fourth and sixth input terminal means are electrically connected to each other and, through first resistance means, to one electrical end of said vehicle-engine energizing switch means and through said vehicle-engine energizing switch means to said source of electrical potential; wherein said first, third and fifth input terminal means are electrically connected to each other and, through second resistance means, to said fourth output terminal means; and further comprising third resistance means; capacitor means; said third resistance means having one electrical end electrically connected to said power supply conductor means and having an other electrical end thereof electrically connected to one electrical side of said capacitor means; wherein said capacitor means has its other electrical side electrically connected to ground potential; and wherein said seventh and eighth input terminal means are electrically connected to said third resistance means and said capacitor means in a manner as to be generally electrically between said third resistance means and said capacitor means.

92. The combination of an automotive vehicle a window heater and timing control means; wherein said vehicle comprises a window with electrically energizable heater means associated therewith and vehicle-engine energizing switch means; and wherein said window heater and timing control means comprises an electrical switching and timing assembly; said electrical switching and timing assembly comprising load circuit means and timing circuit means; wherein said load circuit means comprises a load circuit input end and a load circuit output end; said load circuit input end being electrically connected to a source of electrical potential; said load circuit output end being electrically connected to said heater means; manually actuated normally open load switch means situated in series relationship with said load circuit means; said timing circuit means comprising power supply conductor means effective for providing an electrical potential when said load switch means is closed; electrical timing means; said timing circuit means further comprising output switch means and inductive coil means electrically connected thereto; said output switch means being normally open as to thereby maintain said inductive coil means normally de-energized; said manually actuated load switch means being electrically connected at one electrical end thereof to said vehicle-engine energizing switch means and said source of electrical potential; said manually actuated load switch means when actuated to an electrically closed condition being effective to cause said output switch means to become conductive thereby energizing said inductive coil means which holds said normally open manually actuated load switch means closed to continue to energize said heater means and simultaneously energize said electrical timing means; said electrical timing means being effective upon the expiration of a first span of time to cause said output switch means to become non-conductive thereby de-energizing said inductive coil means and causing said load switch means to return to its normally open condition; and with said vehicle-engine energizing switch means remaining closed and said manually actuated load switch means again being moved to an electrically closed condition said electrical timing means again being effective upon the expiration of a second span of time to cause said output switch means to again become non-conductive thereby again de-energizing said inductive coil means and causing said load switch means to again return to its normally open condition; said timing circuit means further comprising first, second, third and fourth gate means; wherein said first gate means comprises first and second input terminal means; wherein said second gate means comprises third and fourth input terminal means; wherein said third gate means comprises fifth and sixth input terminal means; wherein said fourth gate means comprises seventh and eighth input terminal means; wherein said first, second, third and fourth gate means respectively comprise first, second, third and fourth output terminal means; wherein said output switch means comprises transistor means having base terminal means; wherein said first, second and third output terminal means are electrically connected to said base terminal means; wherein said second, fourth and sixth input terminal means are electrically connected to each other and, through first resistance means, to one electrical end of said vehicle-engine energizing switch means and through said vehicle-engine energizing switch means to said source of electrical potential; wherein said first, third and fifth input terminal means are electrically connected to each other and, through said resistance means, to said fourth output terminal means; and further comprising third resistance means; capacitor means; said third resistance means having one electrical end electrically connected to said power supply conductor means and having an other electrical end thereof electrically connected to one electrical side of said capacitor means; wherein said capacitor means has its other electrical side electrically connected to ground potential; and wherein said seventh and eighth input terminal means are electrically connected to said third resistance means and said capacitor means in a manner as to be generally electrically between said third resistance means and said capacitor means.

93. Timing circuit means and electrically openable and closable load circuit means for use in combination with an automotive vehicle having a source of electrical potential, a vehicle-engine energizing switch means and electrical load means; said load circuit means being effective during such times as when electrically closed for supplying an electrical current from said source of electrical potential to said electrical load means; said timing circuit means being effective to cause said load circuit means to become electrically opened upon the expiration of a first span of time subsequent to the moment at which said load circuit means was initially electrically closed; said timing circuit means being further effective to again cause said load circuit means to become electrically opened upon the expiration of a second span of time subsequent to the moment at which said load circuit means was again electrically closed after having been electrically opened by said timing circuit means upon the expiration of said first span of time; and wherein said timing circuit means is electrically energized and made functional every time that said load circuit means is electrically closed.

* * * * *

UNITED STATES PATENT AND TRADEMARK OFFICE

CERTIFICATE OF CORRECTION

PATENT NO. : 4,347,444

DATED : August 31, 1982

INVENTOR(S) : Robert Taylor, Norman A. Rautiola & Gerald K. Miller

It is certified that error appears in the above—identified patent and that said Letters Patent is hereby corrected as shown below:

Column 12, line 43, after "220" insert the symbol ---μf---.

Column 12, line 44, after "47" insert the symbol ---μf ---.

Column 12, line 47, after "287," insert --- 278, ---.

Column 15, line 9, after "26" delete the parenthesis symbol and substitute therefor, a comma (,).

Column 15, line 12, after "664" cancel "and" and substitute therefor --- as ---.

Claim 1, line 18 thereof, after "second" cancel "predetermined" and substitute therefor --- preselected ---.

Claim 8, line 1 thereof, change "switch" to --- switching ---.

Claim 41, line 10 thereof, after "circuit" insert --- board ---.

Claim 68, line 2 thereof, change "claim 64" to --- claim 65 ---.

Claim 80, line 56 thereof, after "capacitor means" insert a comma (,).

Claim 87, line 1 thereof, change "claim 85" to --- claim 82 ---.

Claim 92, line 70 thereof, immediately before "resistance" delete "said" and substitute therefor --- second ---.

Signed and Sealed this

Twenty-second Day of March 1983

[SEAL]

Attest:

GERALD J. MOSSINGHOFF

Attesting Officer

Commissioner of Patents and Trademarks